US007215917B2

(12) United States Patent
Aruga et al.

(10) Patent No.: US 7,215,917 B2
(45) Date of Patent: May 8, 2007

(54) FUSING DEVICE WITH STABLE NIPPING PORTION

(75) Inventors: Tomoe Aruga, Nagano (JP); Ken Ikuma, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/180,317

(22) Filed: Jul. 12, 2005

(65) Prior Publication Data

US 2006/0013625 A1 Jan. 19, 2006

(30) Foreign Application Priority Data

Jul. 13, 2004 (JP) ..... P2004-205606
Jul. 13, 2004 (JP) ..... P2004-205607
Jul. 13, 2004 (JP) ..... P2004-205608
Jul. 13, 2004 (JP) ..... P2004-205609
Jul. 13, 2004 (JP) ..... P2004-205610
Jul. 16, 2004 (JP) ..... P2004-209397

(51) Int. Cl.
*G03G 15/20* (2006.01)

(52) U.S. Cl. ..... 399/329

(58) Field of Classification Search ..... None
See application file for complete search history.

(56) References Cited

U.S. PATENT DOCUMENTS 5,621,512 A 4/1997 Uehara et al.
2005/0100372 A1 5/2005 Fuma
2005/0141914 A1* 6/2005 Hiraoka et al. ..... 399/69

FOREIGN PATENT DOCUMENTS

| | | |
|---|---|---|
| EP | 1 367 461 | 12/2003 |
| JP | 59-188673 | 10/1984 |
| JP | 06-040235 | 2/1994 |
| JP | 3084692 | 7/2000 |
| JP | 3480250 | 10/2003 |
| JP | 2004-004234 | 1/2004 |
| JP | 2004-004235 | 1/2004 |

* cited by examiner

*Primary Examiner*—Quana Grainger
(74) *Attorney, Agent, or Firm*—Hogan & Hartson LLP

(57) ABSTRACT

In a device for fusing a toner image on a recording medium, a first roller provided with a heat source and a second roller are provided. A stretcher is elongated in a longitudinal direction of the second roller. An endless belt is stretched by an outer circumferential face of the second roller and a first face of the stretcher, and circulated in accordance with rotation of the first roller and the second roller. The endless belt is sandwiched between the first roller and the second roller to form a nipping portion through which the recording medium passes to fuse the toner image thereon. A supporter is disposed between the second roller and the stretcher. The supporter is elongated in the longitudinal direction of the second roller, and is provided with at least one first projection having a first face which is brought into slide contact with at least a longitudinal center portion of the outer circumferential face of the second roller.

27 Claims, 24 Drawing Sheets

Fig. 1A
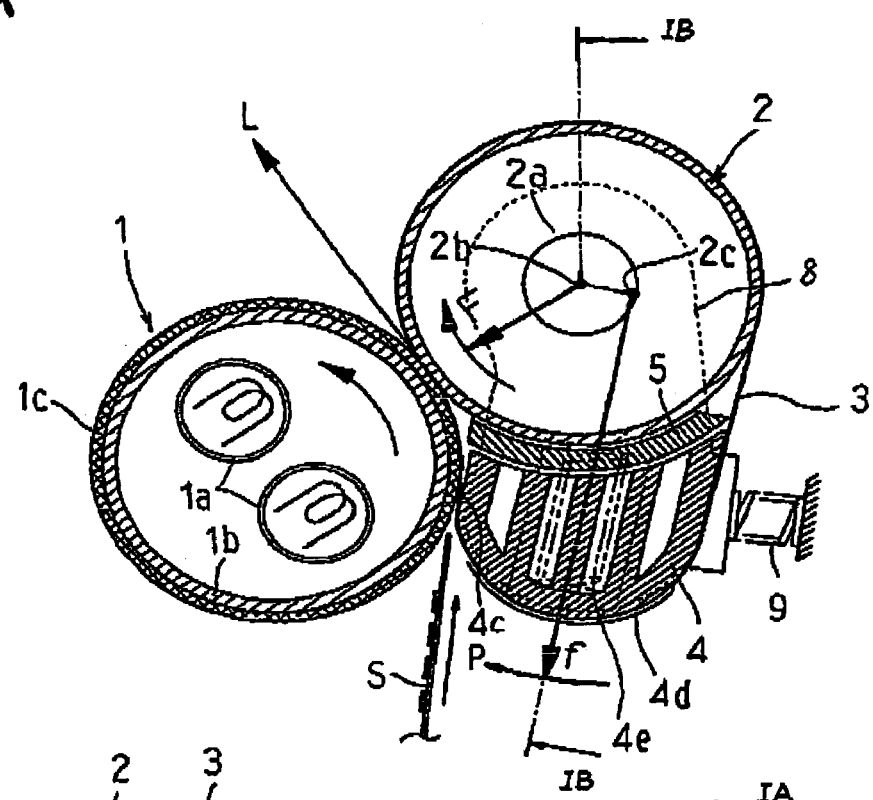
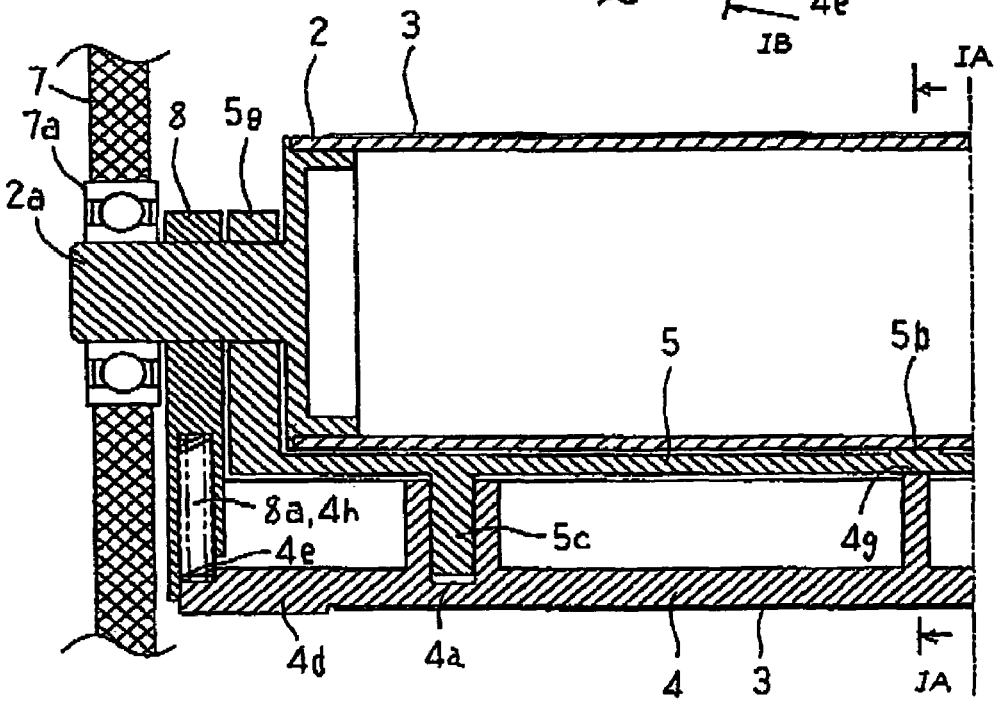
Fig. 1B

Fig. 7A
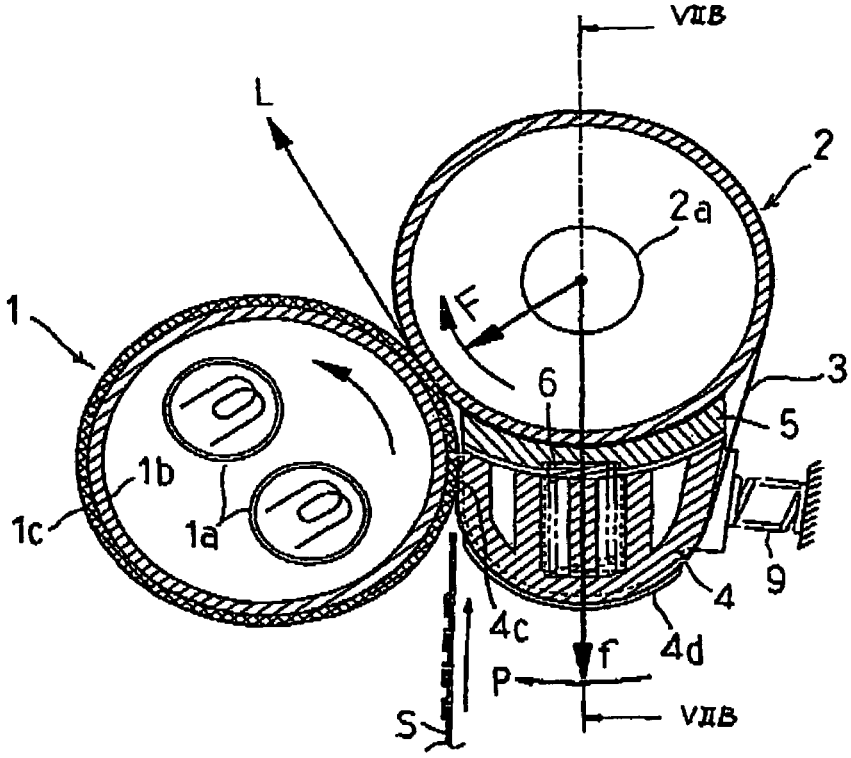
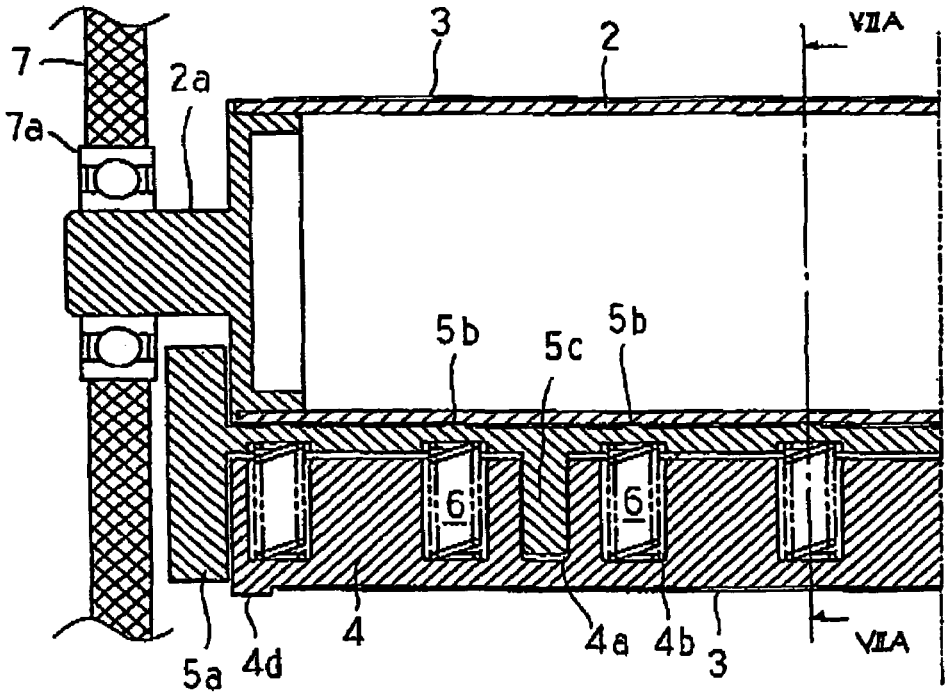
Fig. 7B

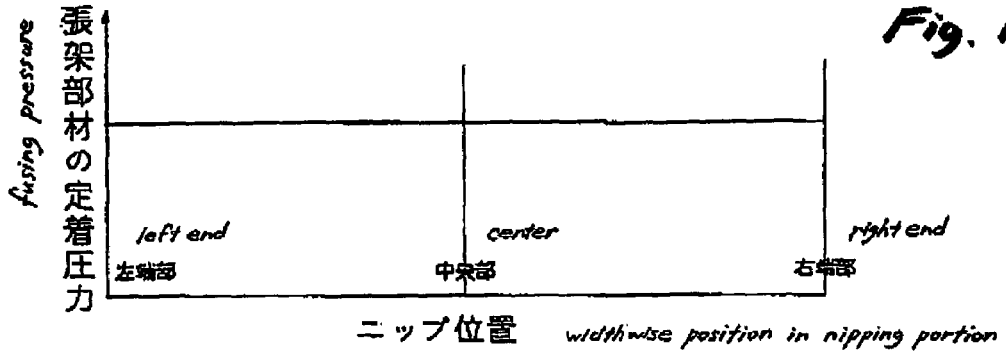
Fig. 11A
fusing pressure
張架部材の定着圧力
left end
左端部
center
中央部
right end
右端部
ニップ位置 widthwise position in nipping portion

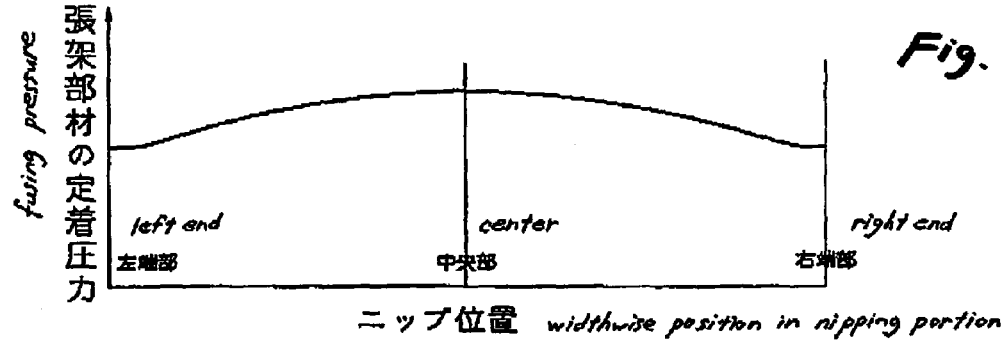
Fig. 11B
fusing pressure
張架部材の定着圧力
left end
左端部
center
中央部
right end
右端部
ニップ位置 widthwise position in nipping portion

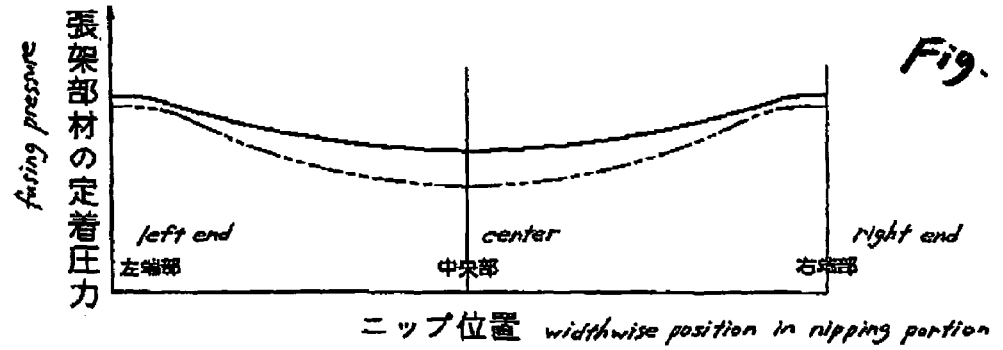
Fig. 11C
fusing pressure
張架部材の定着圧力
left end
左端部
center
中央部
right end
右端部
ニップ位置 widthwise position in nipping portion

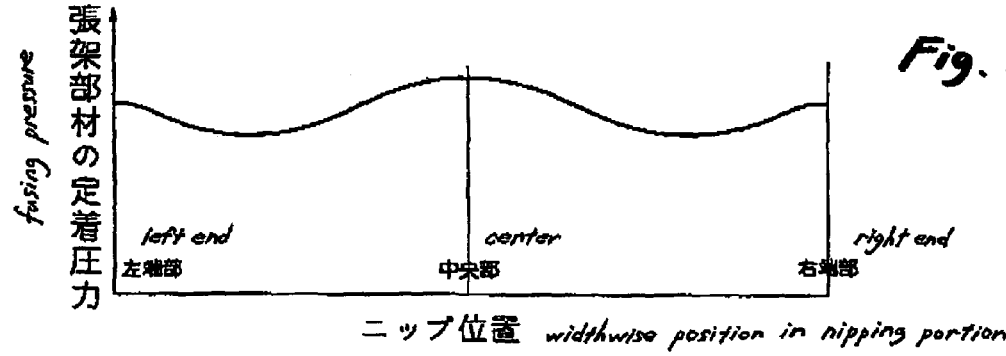
Fig. 11D
fusing pressure
張架部材の定着圧力
left end
左端部
center
中央部
right end
右端部
ニップ位置 widthwise position in nipping portion Fig. 12A
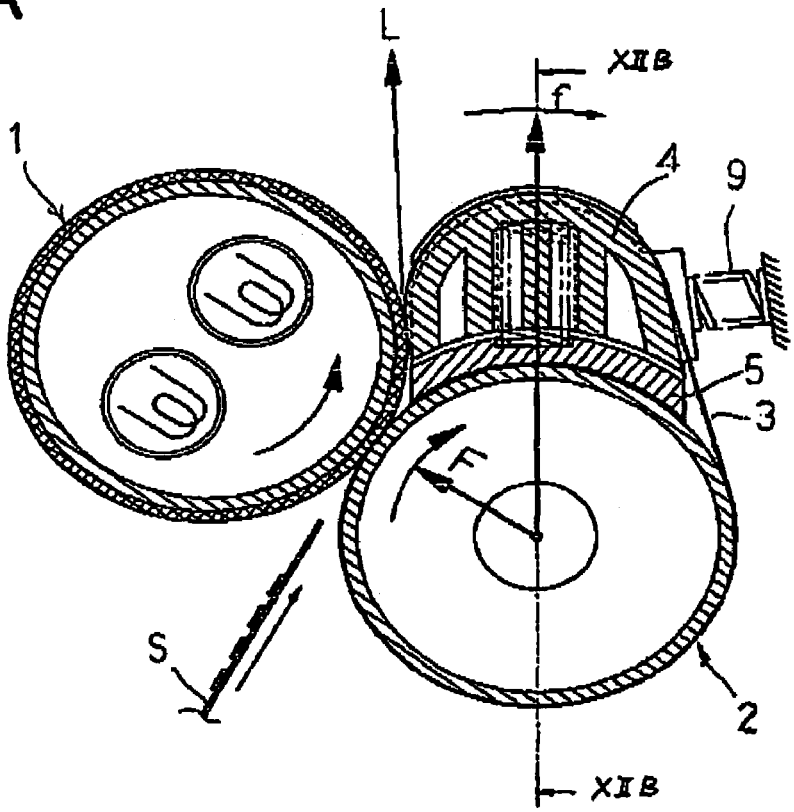
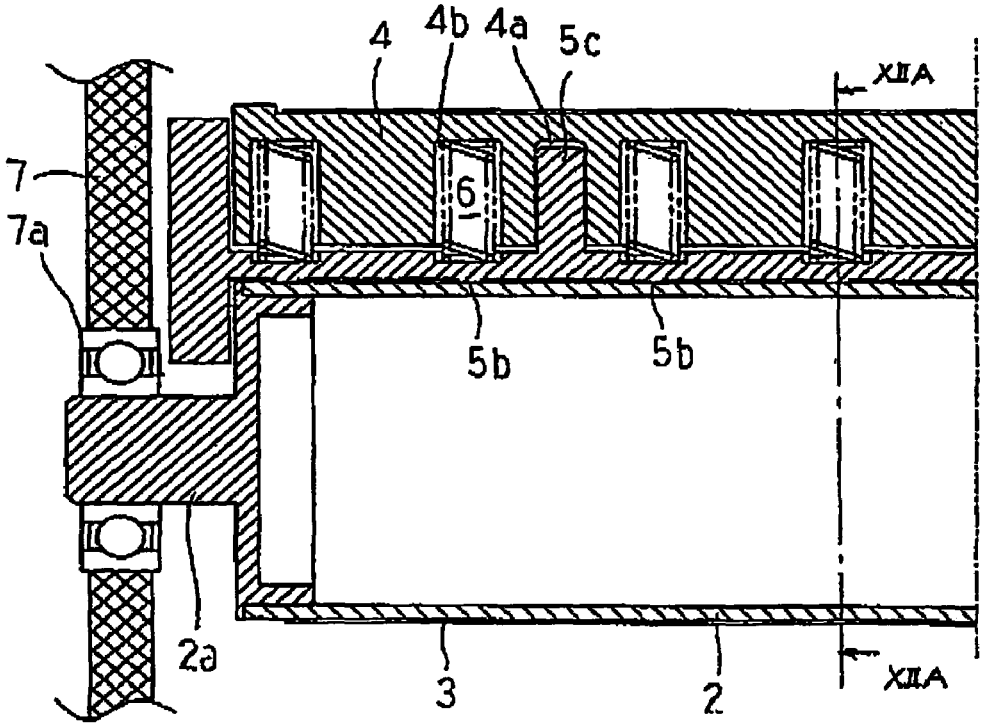
Fig. 12B Fig. 14A
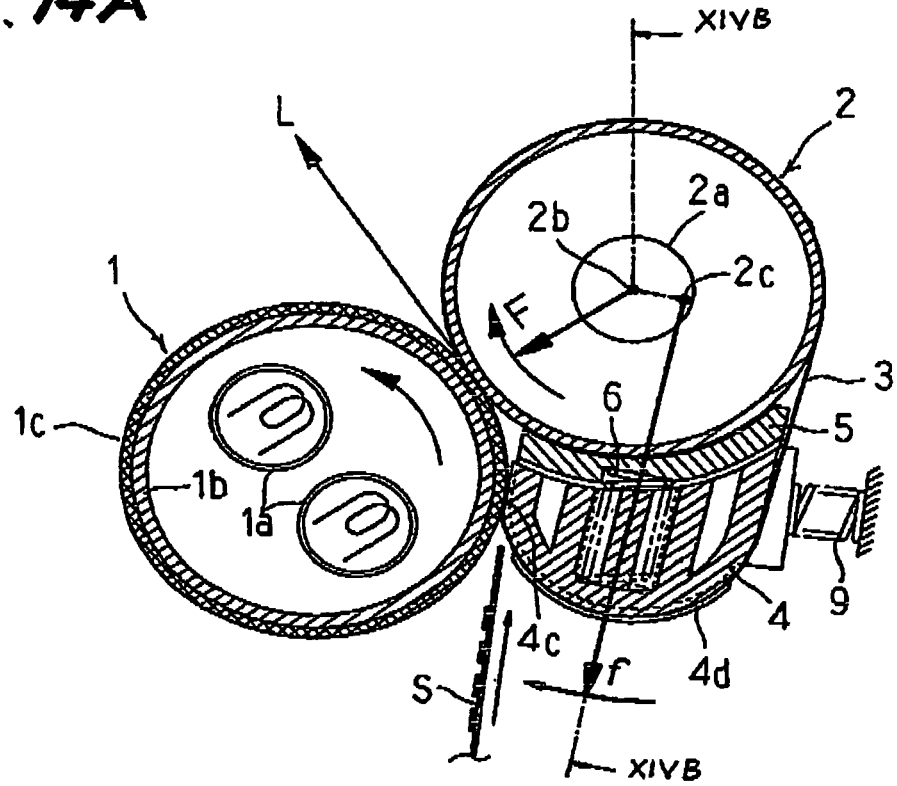
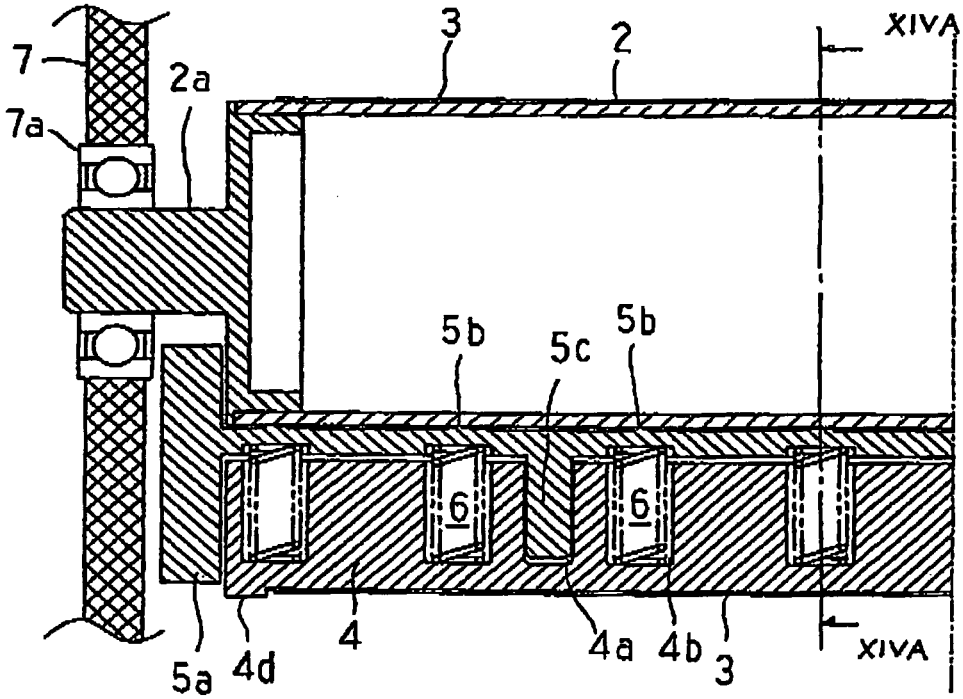
Fig. 14B Fig. 16A
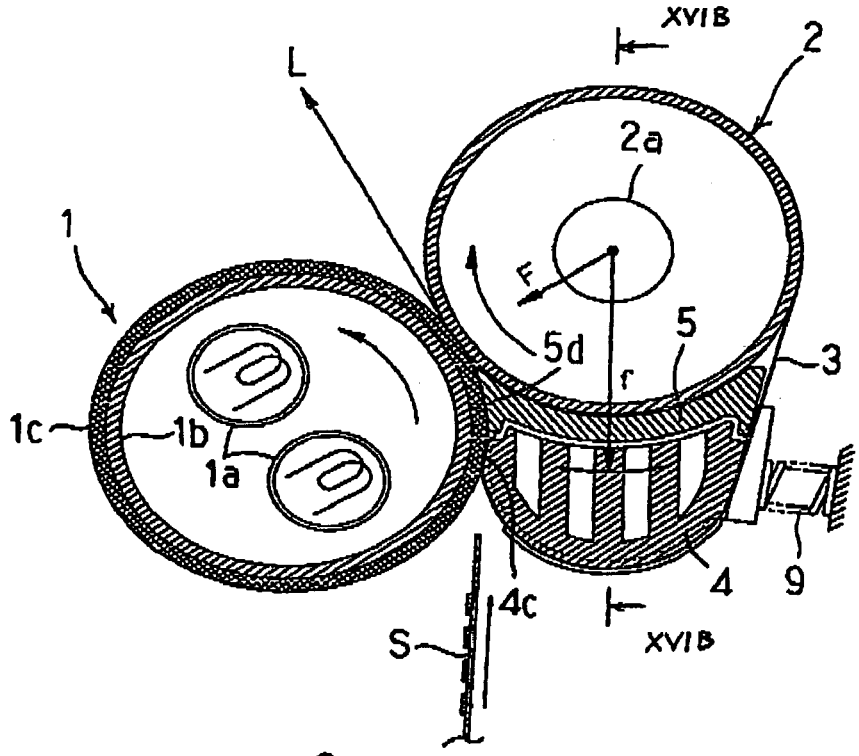
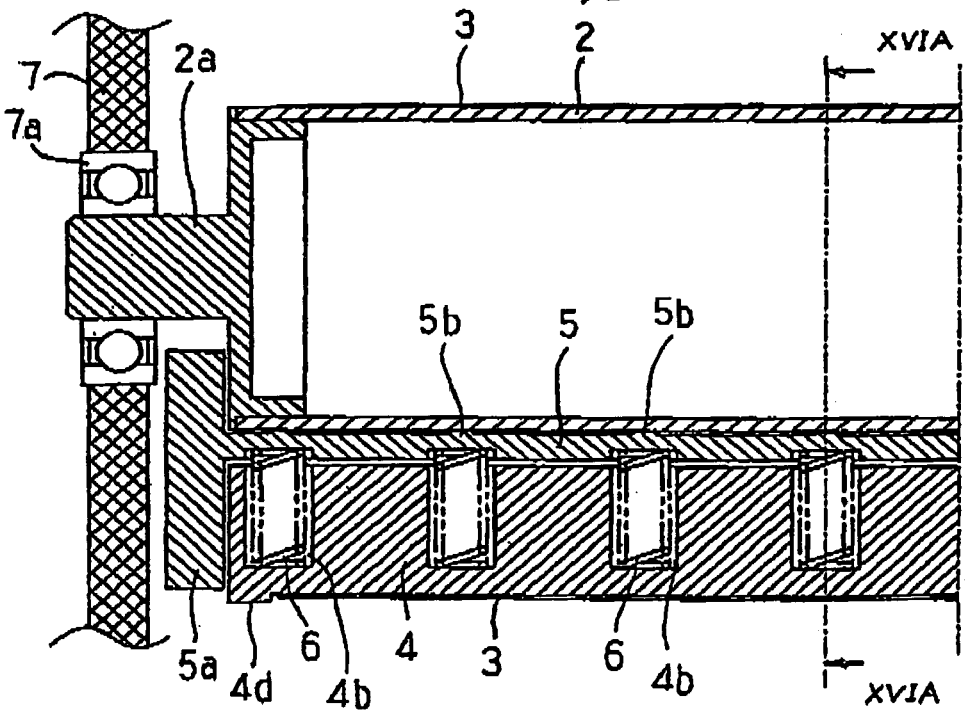
Fig. 16B Fig. 19A
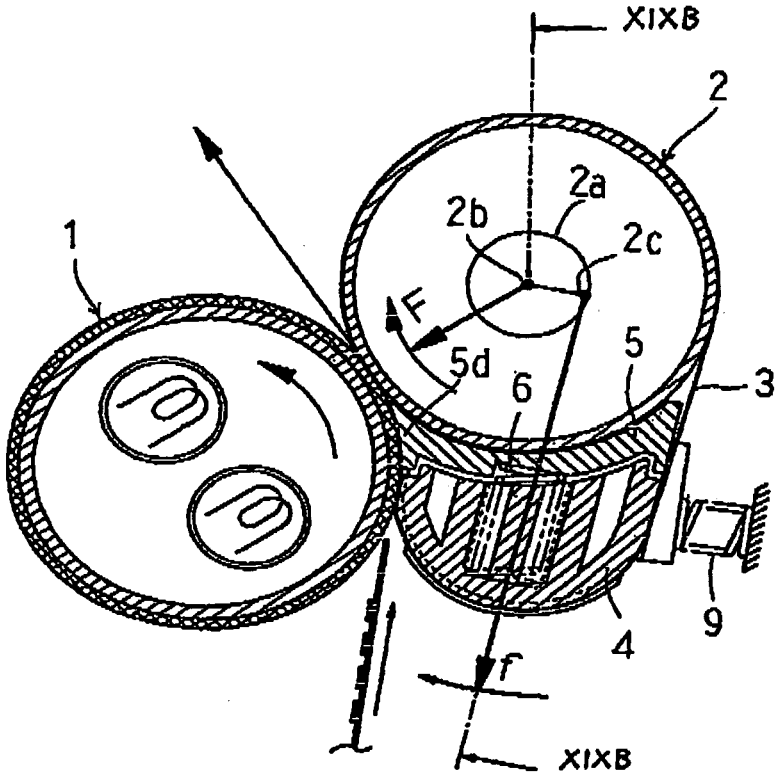
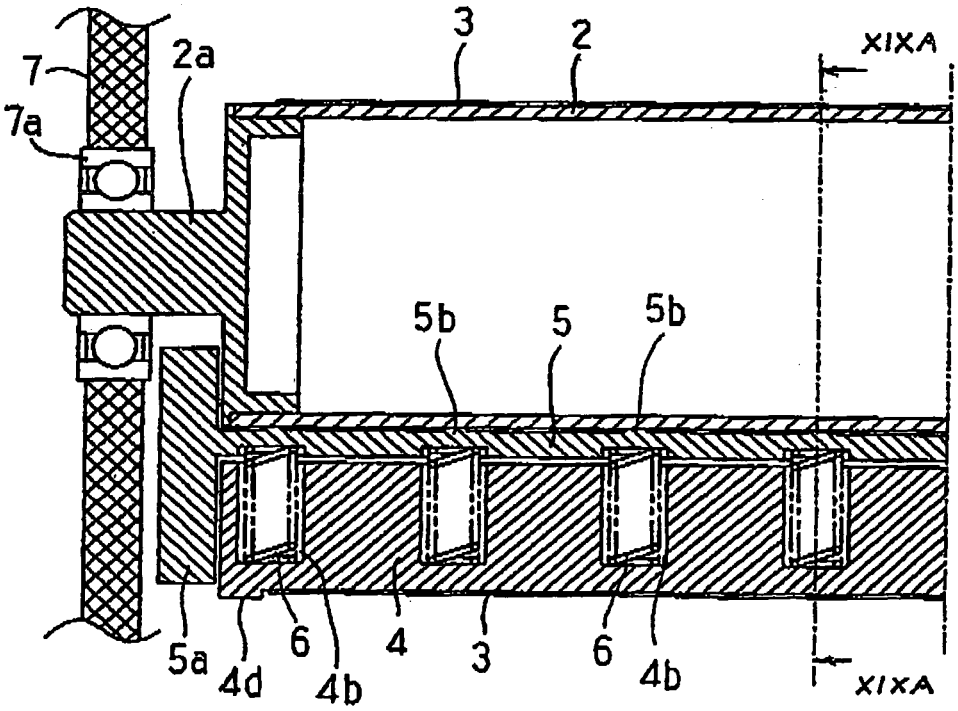
Fig. 19B Fig. 20A
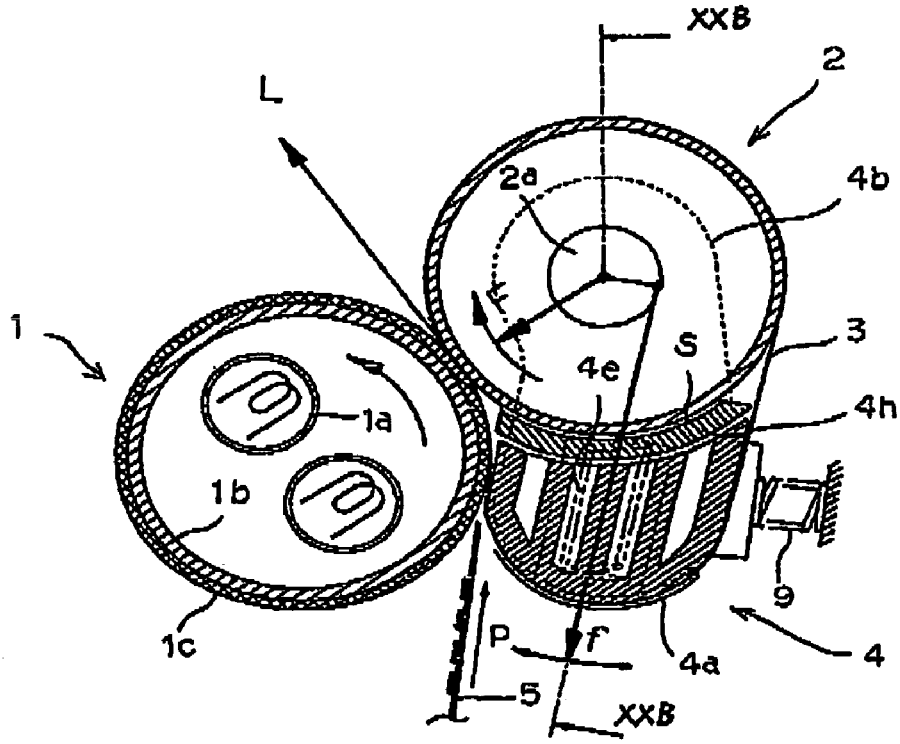
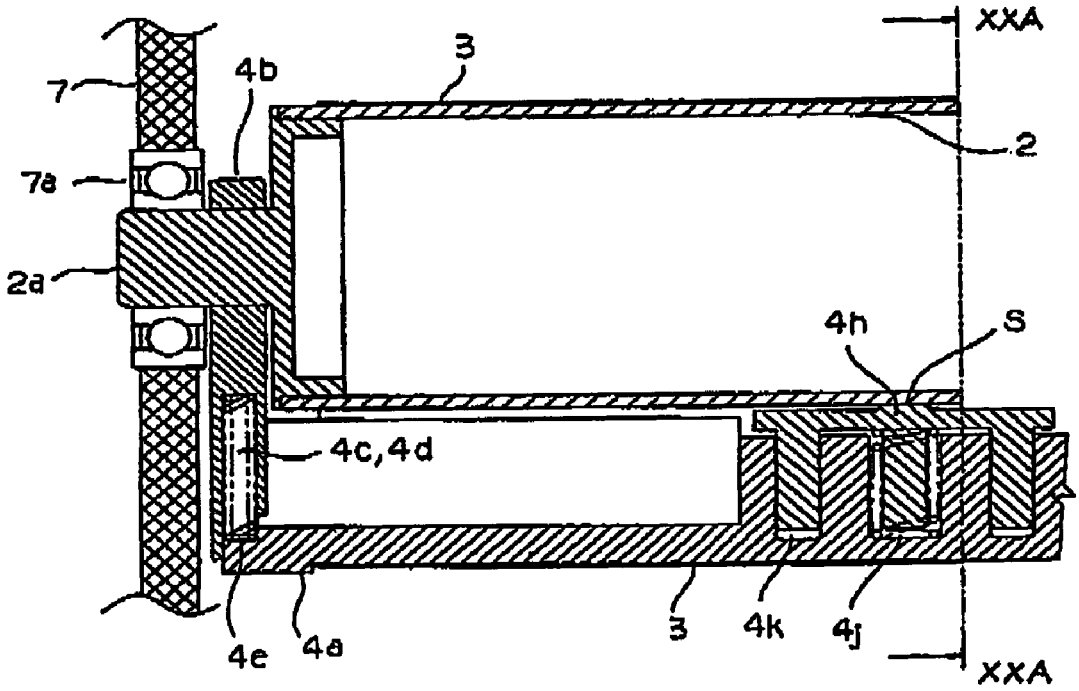
Fig. 20B Fig. 23A
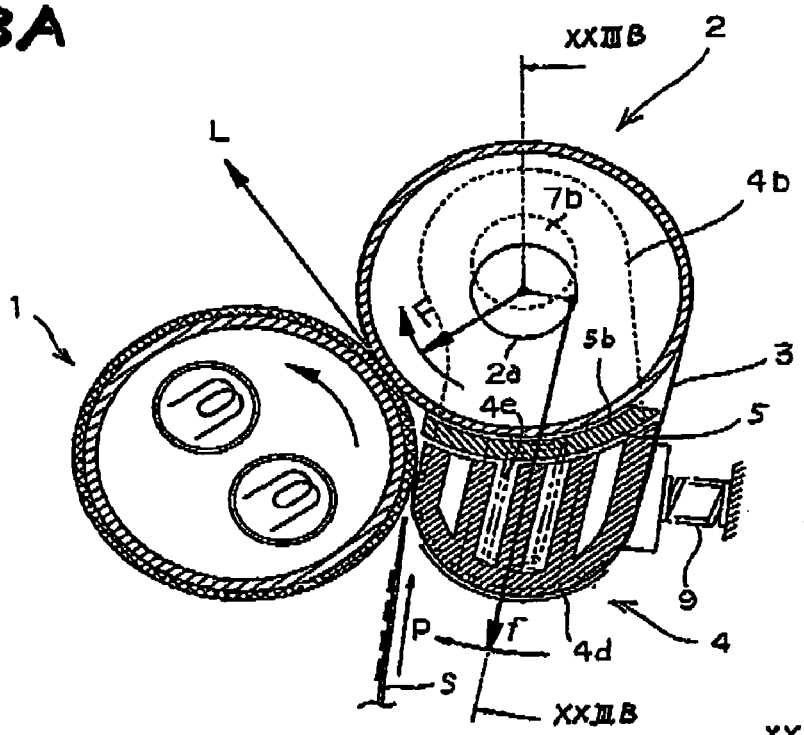
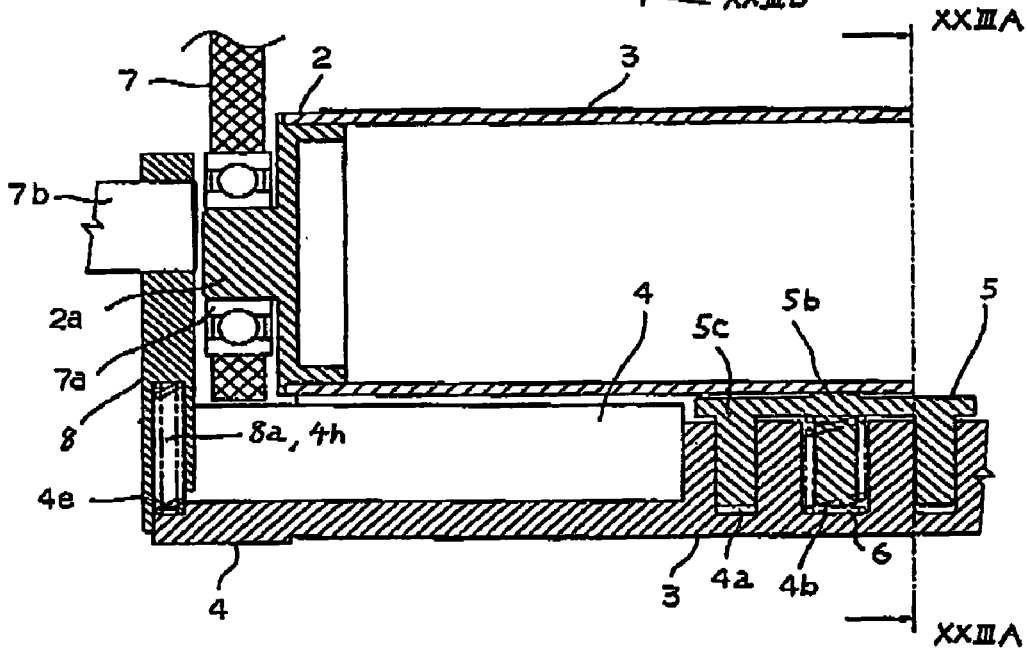
Fig. 23B

FUSING DEVICE WITH STABLE NIPPING PORTION

BACKGROUND OF THE INVENTION

The present invention relates to a fusing device which fuses a nonfused toner image formed on a sheet medium and comprises a heating roller, a pressing roller for pressing an object against the heating roller, a heat-resistant belt which is wrapped around an outer peripheral surface of the pressing roller and travels while being nipped between the heating roller and the pressing roller, and a stretcher for stretching the heat-resistant belt.

The following two types of fusing devices have been proposed as a heating-roller-type fusing device which is mounted on an image forming apparatus such as a copier, a printer, or a facsimile and which fuses a nonfused toner image on a transfer material through contact thermo-fusing. Namely, one type of fusing device comprises a heating roller whose surface is coated with an elastic body and which has a built-in heat source and is capable of rotating; an endless heat-resistant belt stretched by a plurality of support rollers; and a pressing member which wraps the heat-resistant belt around the heating roller over only a predetermined angle to thus form a nipping portion and which locally applies pressure, which is greater than that applied to the other areas, to the heat-resistant belt at an exit of the nipping portion, to thus cause distortion in the elastic body on the surface of the heating roller. The fusing device facilitates output of the sheet medium from the nipping portion (see, e.g., Japanese Patent No. 3084692). The other type of fusing device has a pressing member which has a projecting section and is provided at the inside of the endless heat-resistant belt, thereby decreasing a minute pressure area in the nipping portion (see, e.g., Japanese Patent No. 3480250).

The fusing devices require a plurality of support rollers and rotary bearings thereof. This renders the fusing device expensive as well as complicated and bulky; and inevitably makes an image forming apparatus equipped with the fusing device complicated, bulky, and expensive. Further, when the circumference of the heat-resistant belt becomes longer and the belt is moved over a predetermined path, the heat-resistant belt is deprived of thermal energy by a plurality of support rollers, and the amount of naturally-dissipated heat is increased In accordance with the circumference. Accordingly, a longer time must be consumed before the temperature of the heat-resistant belt reaches a predetermined level. This undesirably entails a longer so-called warm-up time which elapses from when power is turned on until fusing becomes feasible.

The heat resistant-belt is wrapped around the heating roller over only an angle which enables formation of a nipping portion, and pressure which is greater than that applied to the other areas is locally applied to the heat-resistant belt at the exit of the nipping portion, to thus cause distortion in the elastic layer of the heating roller. This configuration is suitable for preventing the sheet medium from wrapping around the heating roller. However, the sheet medium output along the distortion of the elastic layer is curled in imitation of this distortion or is subjected to deformation, such as occurrence of wrinkles, caused by local high pressure.

In addition to these fusing devices, another fusing device (see, e.g., Japanese Patent Publication No. 6-40235B) has also been proposed. The device deforms rollers by the pressure set between the rollers, to thus form a nipping length over which a sheet medium is to contact the rollers.

A sheet medium carrying a nonfused toner image is caused to pass through the nipping portion, thereby fusing the toner image. The rollers are driven by selecting a first speed or a second speed as a drive speed of the rollers in accordance with characteristics of the sheet medium. However, the heat capacity of the rollers is large, and, hence, consumption of a long warm-up time is undesirably required. In addition, the sheet medium, having passed through the long nipping portion formed by deforming the rollers with pressure, undergoes stress derived from the pressure, as in the case of the former fusing device, which in turn causes deformation of the sheet medium, such as occurrence of a curl or wrinkles.

Still another fusing device (see, e.g., Japanese Patent Publication No. 2004-4235A) has been proposed as a device which solves the above-described drawbacks. A stretching member is placed at a position which is upstream with respect to the moving direction of a heat-resistant belt and where the heat-resistant belt turns itself around a heating roller to thus form a nipping portion, with reference to a tangential line of a press contact position defined between the heating roller and a pressing roller. This stretching member is supported so as to be swayable. As a result, the structure of the heat-roller-type fusing device can be subjected to simplification, downsizing, and cost-saving. A warm-up time can be shortened, and deformation of an output sheet medium, such as occurrence of a curl or wrinkles in the sheet medium, can be prevented by reducing stress imposed on the sheet medium.

The structures of the respective related-art fusing devices that have been proposed thus far are effective means for enhancing the fusing characteristic. However, the structures are not sufficient for forming a stable nipping portion in the axial direction of the heating roller and that of the pressing roller; namely, over the entire longitudinal area of the heating roller and that of the pressing roller. More specifically, the nipping portion is slightly relevant to axial deflection of the heating roller and that of the pressing roller attributable to pressure or deformation of the pressing member or that of the stretching member, such as a twist, a warpage, or an axial torsion. For these reasons, under the present circumstances, the nipping portion is under influence of such deformation, and difficulty is encountered in preventing the nipping portion from becoming unstable. Thus, enhancement of the fusing characteristic cannot be achieved.

In addition, there may arise a case where creeping deformation arises under influence of the heating roller which is heated to a temperature as high as about 200° C. Particularly, when the stretcher is formed from a plastic material having low thermal capacity, on the assumption that the stretcher is effective for shortening a warm-up time, the phenomenon of occurrence of deflection or deformation has become noticeable, which is not preferable for forming a stable nipping portion.

SUMMARY OF THE INVENTION

It is therefore an object of the invention to provide a fusing device in which a stable nipping portion can be formed with simple structure, thereby enhancing fusing characteristic.

In order to achieve the above object, according to the invention, there is provided a device for fusing a toner image on a recording medium, comprising:

a first roller, provided with a heat source;

a second roller;

a stretcher, elongated in a longitudinal direction of the second roller;

an endless belt, stretched by an outer circumferential face of the second roller and a first face of the stretcher, and circulated in accordance with rotation of the first roller and the second roller, the endless belt being sandwiched between the first roller and the second roller to form a nipping portion through which the recording medium passes to fuse the toner image thereon; and a supporter, disposed between the second roller and the stretcher, the supporter being elongated in the longitudinal direction of the second roller, and provided with at least one first projection having a first face which is brought into slide contact with at least a longitudinal center portion of the outer circumferential face of the second roller.

Preferably, the stretcher is provided with at least one second projection having a second face which is brought into contact with the supporter so as to oppose to the first projection.

Preferably, the fusing device further comprises:

a pair of arm members, each of which has a first end which is pivotably fitted with a rotary shaft of the second roller and a second end which is coupled with one of longitudinal ends of the stretcher, so that the stretcher is retractably brought into contact with the first roller through the belt; and a coiled spring, interposed between the one of the longitudinal ends of the stretcher and the second end of the arm members so as to urge the stretcher in a direction separating from the second roller.

Here, it is preferable that an axial line of the coiled spring passes through a position which is shifted from a rotary axis of the second roller in a direction separating from the first roller.

It is also preferable that both longitudinal ends of the supporter are pivotably fitted with the rotary shaft of the second roller.

It is also preferable that both longitudinal ends of the supporter are formed with flanges which are respectively fitted with both longitudinal ends of the second roller.

Preferably, the first face of the first projection and the outer circumferential face of the second roller have an identical curvature.

Preferably, the second face of the second projection and a face of the supporter contacting the second projection have an identical curvature.

Preferably, a portion of the stretcher which is to be brought into contact with the first roller through the belt is made flat.

Preferably, the supporter is provided with a projection, and the stretcher is provided with a hole into which the projection is fitted.

Preferably, the fusing device further comprises an urging member, which urges the stretcher toward the first roller.

Preferably, a longitudinal center portion of the first face of the stretcher has a smaller curvature than both longitudinal ends thereof.

Preferably, a plurality of coiled springs, disposed between the stretcher and the supporter and arrayed in the longitudinal direction of the second roller.

Here, it is preferable that the first projection is provided so as to oppose to each of the coiled springs.

It is also preferable that an axial line of each of the coiled springs passes through a position which is shifted from a rotary axis of the second roller in a direction separating from the first roller.

It is also preferable that at least two of the springs have different urging forces.

It is further preferable that an urging force of one of the springs disposed in a longitudinal center portion of the stretcher is greater than an urging force of another one of the springs disposed in a longitudinal end portion of the stretcher.

Alternatively, that an urging force of one of the springs disposed in a longitudinal center portion of the stretcher is smaller than an urging force of another one of the springs disposed in a longitudinal end portion of the stretcher.

Alternatively, it is preferable that an urging force of two of the springs disposed in a longitudinal center portion and a longitudinal end portion of the stretcher is greater than an urging force of another one of the springs disposed in a position between the longitudinal center portion and the longitudinal end portion.

Preferably, the stretcher is disposed at an upstream side, in the circulating direction of the belt, of a contact position at which the second roller contacts the first roller through the belt. The belt is wrapped around an outer circumferential face of the first roller by the stretcher to form the nipping portion.

Alternatively, the stretcher is disposed at a downstream side, in the circulating direction of the belt, of a contact position at which the second roller contacts the first roller through the belt. The belt is wrapped around an outer circumferential face of the first roller by the stretcher to form the nipping portion.

Preferable, the supporter has a portion operable to press the belt against the first roller.

Preferably, a plurality of the first projections are disposed so as to come in contact with separate positions of the outer circumferential face of the second roller in a rotating direction thereof.

Here, it is preferable that the first projections are provided as roller members.

Preferably, a plurality of the first projections are disposed so as to come in contact with separate positions of the outer circumferential face of the second roller in the longitudinal direction thereof.

Preferably, the fusing device further comprises:

a pair of arm members, each of which has a first end which is pivotably fitted with a shaft member and a second end which is coupled with one of longitudinal ends of the stretcher, so that the stretcher is retractably brought into contact with the first roller through the belt; and a coiled spring, interposed between the one of the longitudinal ends of the stretcher and the second end of the arm members so as to urge the stretcher in a direction separating from the second roller.

The shaft member is disposed in the vicinity of a rotary shaft of the second roller.

According to the invention, there is also provided an image forming apparatus Incorporating the above fusing device, comprising:

an image former, which forms the toner image on the recording medium; and a transporter, which transports the recording medium having the toner image to the fusing device.

According to the present invention, axial deflection or creeping deformation of the stretcher can be prevented by the first projection of the stretcher and the second projection of the supporter. The axially unstable state of nipping portion can be mitigated, and a nipping portion which is stable over the entire axial length thereof can be formed. Frictional force developing between the belt and the stretcher is added to the pressing force of the stretcher which lightly presses the belt against the first roller, in response to the frictional force stemming from the tensile force of the belt. When the belt is driven by the second roller, pressed continuous nipping portion, where the belt is wrapped around the first roller, can be formed in an area between the area where the stretcher is lightly pressed against the first roller and the area where the second roller is pressed against the first roller. Formation of more a stable, preferable nipping portion becomes possible.

Component force of the tensile force imparted to the stretcher is added to the pressing force of the stretcher which lightly presses the belt against the first roller. Pressed continuous nipping portion, where the belt is wrapped around the first roller, can be formed in an area between the area where the stretcher is lightly pressed against the first roller and the area where the second roller is pressed against the first roller. Hence, a nonuniform status can be mitigated, and formation of more stable, preferable nipping portion can be realized.

According to the present invention, since the supporter is interposed between the second roller and the stretchers and a plurality of coiled springs are interposed between the stretcher and the supporter, the axial deflection or creeping deformation of the stretcher can be prevented and formation of the nipping portion which is entirely stable in the longitudinal direction of the second roller can be enabled.

In the area between the area where the stretcher is lightly pressed against the first roller and the area where the second roller is pressed against the first roller, if the force for pressing the belt against the first roller becomes deficient or unstable, there may arise a case where stable, preferable fusing cannot be performed in the case of, particularly, a thick sheet material or the like. For this reason, the stretcher is pressed by the flat portion, and the component force of tensile force and the frictional force are added to the force as pressing force. As a result, the belt is positively wrapped around the first roller in the nipping portion, so that a stable, pressed, continuous nipping portion can be formed. Thus, unstable state can be lessened, and a preferable nipping portion can be formed.

According to the present invention, the ability of both longitudinal ends of the stretcher to transport the recording medium can be enhanced, thereby preventing occurrence of wrinkles in the center of the recording medium. Moreover, the fusing pressure in the longitudinal center portion of the stretcher can be increased, to thus enhance the ability of both longitudinal ends of the same to transport the recording medium.

According to the present Invention, the force corresponding to the urging forces of the coiled springs act on the stretcher, thereby imparting tensile force to the belt. Concurrently, the rotational force of the second roller is transmitted to the supporter by frictional force stemming from the frictional contact surface (the first face of the stretcher).

According to the invention, the shaft member is located in the vicinity of the axial center of the rotary shaft, thereby changing the length of the arm members for the stretcher. Depending on the position of the shaft member, the frictional force stemming from the belt can change the pressing force acting on the stretcher. Thus, the force for lightly pressing the belt against the first roller can be adjusted.

BRIEF DESCRIPTION OF THE DRAWINGS

FIG. 1A is a section view of a fusing device according to a first embodiment of the invention;

FIG. 1B is a section view taken along a line IB—IB in FIG. 1A;

FIG. 7A is a section view of a fusing device according to a fourth embodiment of the invention;

FIG. 7B is a section view taken along a line VIIB—VIIB in FIG. 7A;

FIGS. 11A to 11D are graphs showing a relationship between a widthwise position in the nipping portion and a fusing pressure in various conditions;

FIG. 12A is a section view of a fusing device according to a sixth embodiment of the invention;

FIG. 12B is a section view taken along a line XIIB—XIIB in FIG. 12A;

FIG. 14A is a section view of a fusing device according to an eighth embodiment of the invention;

FIG. 14B is a section view taken along a tine XIVB—XIVB in FIG. 14A;

FIG. 16A is a section view of a fusing device according to a tenth embodiment of the invention;

FIG. 16B is a section view taken along a line XVIB—XVIB in FIG. 16A;

FIG. 19A is a section view of a fusing device according to a twelfth embodiment of the invention;

FIG. 19B is a section view taken along a line XIXB—XIXB in FIG. 19A;

FIG. 20A is a section view of a fusing device according to a thirteenth embodiment of the invention;

FIG. 20B is a section view taken along a line XXB—XXB in FIG. 20A;

FIG. 23A is a section view of a fusing device according to a sixteenth embodiment of the invention;

FIG. 23B is a section view taken along a line XXIIIB—XXIIIB in FIG. 23A.

DETAILED DESCRIPTION OF THE EMBODIMENTS

Figure 2:
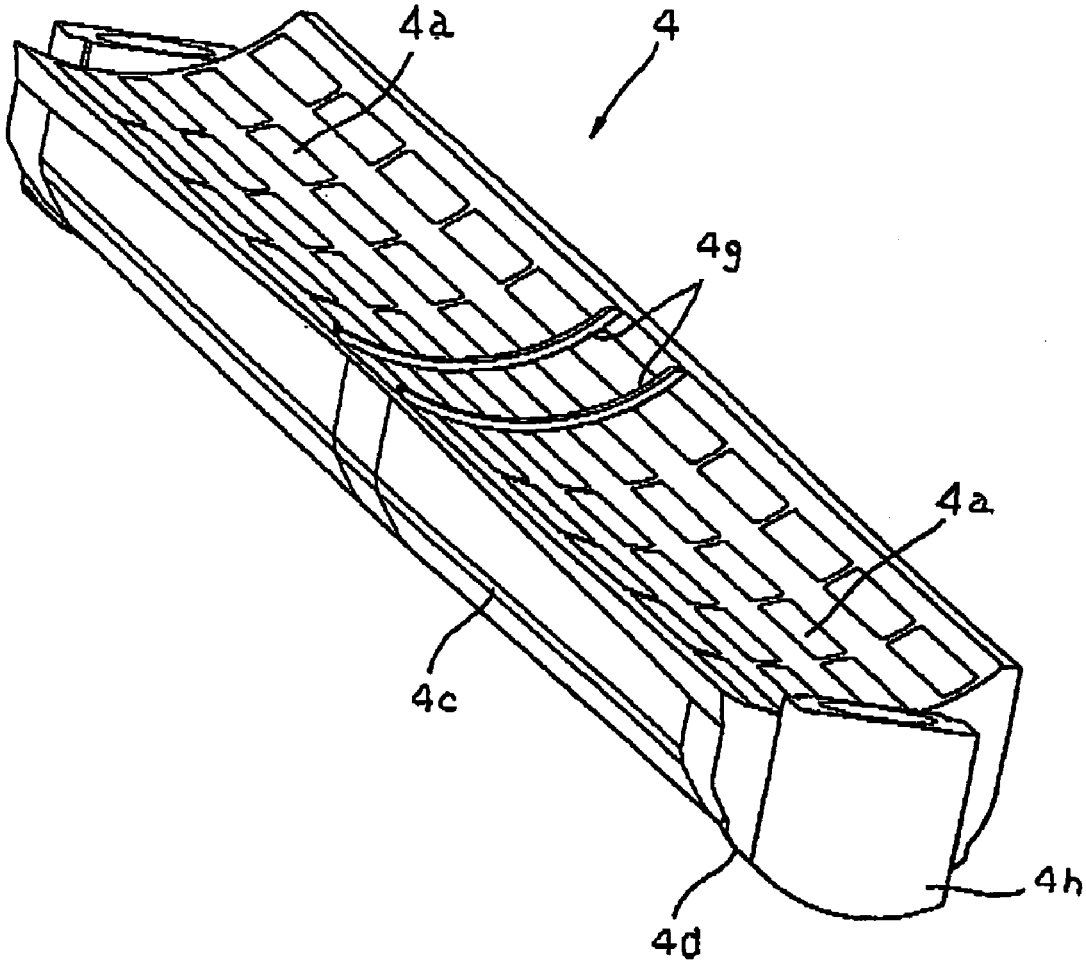
FIG. 2 is a perspective view of a stretcher in the fusing device of FIG. 1A.
Figure 3:
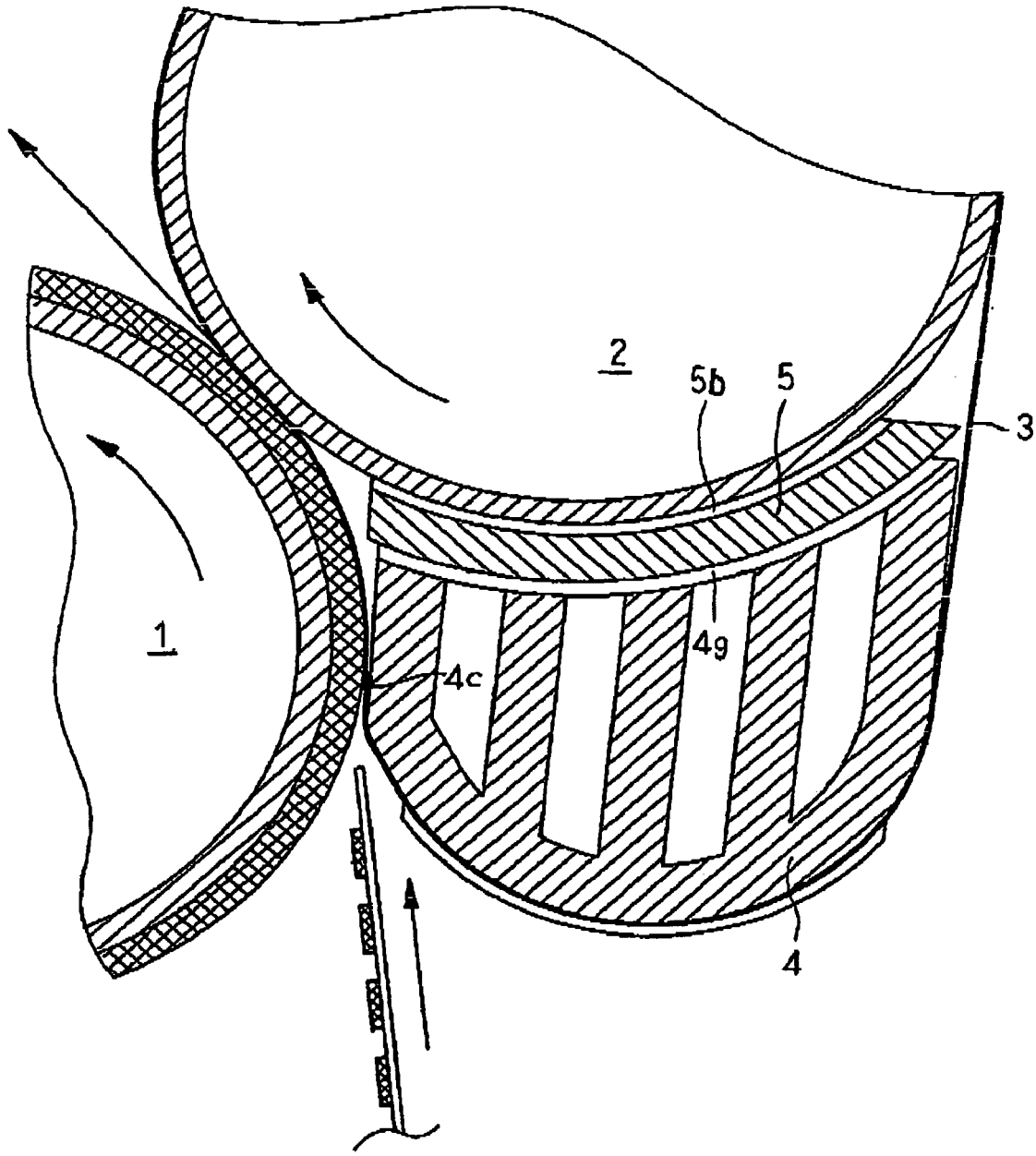
FIG. 3 is an enlarged section view of a nipping portion in the fusing device of FIG. 1A.

Embodiments of the invention will be described below in detail with reference to the accompanying drawings.

FIGS. 1A and 1B shows a fusing device according to a first embodiment of the invention. A heating roller 1 is formed by coating the outer peripheral face of a pipe material with an elastic body 1*c* having a thickness of 0.4 mm or thereabouts. The pipe material has an outer diameter of about 25 mm and a thickness of about 0.7 mm and is taken as the roller base material 1*b*. The heating roller 1 incorporates as the heat sources two columnar halogen lamps 1*a*, each consuming electric power of 1050 watts. A pressing roller 2 is formed by coating an outer peripheral face of a pipe material with an elastic material having a thickness of about 0.2 mm. The material has, e.g., an outer diameter of about 25 mm and a thickness of about 0.7 mm and is taken as a roller base material. The pressing roller 2 is configured such that compression force arising between the heating roller 1 and the pressing roller 2 assumes a value of 10 kg or less and such that a nipping length assumes a value of about 10 mm. The pressing roller 2 is disposed opposite the heating roller 1 and is rotatable in the direction of the illustrated arrow.

According to the present embodiment, the outer diameter of the heating roller 1 and that of the pressing roller 2 are set to a smaller value on the order of 25 mm or thereabouts. Hence, the sheet medium S subjected to the fusing does not wind itself around the heating roller 1 or a heat-resistant belt 3, thereby negating a necessity for a member which forcefully exfoliates the sheet medium S. If a PFA layer having a thickness of about 30 μm is provided on the face layer of the elastic body 1*c* of the heating roller 1, the rigidity of the elastic body is enhanced by the amount corresponding to the thickness of the PFA layer As a consequence, the heating roller is subjected to essentially uniform elastic deformation, thereby forming a so-called horizontal nipping portion. An image can be fused in an extremely stable manner without involvement of a difference between the circumferential speed of the heating roller 1 and the transport speed of the belt 3 or that of a sheet medium S.

In the embodiment, the two heat sources 1*a* are housed in the heating roller 1. If heating elements of the halogen lamps are placed in different positions and illuminated selectively, temperature control can be readily performed under conditions involving a difference, such as a difference between a wide sheet medium S and a narrow sheet medium S.

The belt 3 is an endless belt which is nipped between the heating roller 1 and the pressing roller 2 and made movable while being passed around the outer peripheral face of the pressing roller 2 and that of a stretcher 4. The heat-resistant belt is formed from, e.g., a metal tube having a thickness of about 0.03 mm or more, such as a stainless steel tube or an electro-galvanized nickel tube, or a heat-resistant resin tube such as polyimide or silicon.

The stretcher 4 is disposed upstream of the nipping portion, which is located between the heating roller 1 and the pressing roller 2, with respect to the transporting direction of the sheet medium S. Moreover, the stretcher 4 is disposed so as to be pivotable in the direction of arrow P around the rotary shaft 2*a* of the pressing roller 2. The stretcher 4 is configured such that the belt 3 is stretched in the tangential direction of the heating roller 1 while the sheet medium S does not pass through the nipping portion, and such that the heating roller 1 is lightly pressed by a flat face 4*c* from the inside of the belt 3 (see FIG. 2). If the fusing pressure is high at an initial position where the sheet medium S enters the nipping portion, there may arise a case where entry of the sheet medium S does not proceed smoothly and the sheet medium S is fused with its leading edge being crimped. In contrast, when the belt 3 is configured so as to be stretched in the tangential direction of the heating roller 1, an inlet section which enables smooth entry of the sheet medium S can be formed, thereby allowing smooth, stable entry of the sheet medium S.

The stretcher 4 is a crescent-shaped member on which the belt 3 slides over the stretcher 4, and fitted to the inner peripheral face of the heat resistant belt 3 so that tensile force "f" is imparted to the belt 3 in cooperation with the pressing roller 2 and a supporter 5. The stretcher 4 is disposed at a position where the belt 3 is wrapped around the heating roller 1 to thus form a nipping portion. A projection 4*g* regulates deformation by coming into slidable contact with an outer peripheral face of the supporter 5 when the longitudinal center portion of the stretcher 4 is concavely deformed as a result of high tensile force "f" having been imparted to the belt 3 at the widthwise center portion thereof. As shown in, e.g., FIG. 2, the projection 4*g* is provided in the longitudinal center portion of the stretcher 4 on a face opposing to the supporter 5 and has a curved face corresponding to the outer face of the supporter 5.

The belt 3 which is passed around the outer peripheral face of the pressing roller 2 and travels while being nipped between the pressing roller 2 and the heating roller 1 is stretched by the stretcher 4 to turn itself around the heating roller 1, thereby forming a nipping portion. In this case, there may arise a case where axial deflection occurs in the stretcher 4 or where creeping deformation arises under influence of the heating roller 1 which is heated to a temperature as high as about 200° C. Particularly, when the stretcher 4 is formed from a plastic material having low thermal capacity, on the assumption that the stretcher is effective for shortening a warm-up time, the phenomenon of occurrence of deflection or deformation has become noticeable, which is not preferable for forming a stable nipping portion. The projection 4*g* can prevent occurrence of such axial deflection or creeping deformation by a clearance having a predetermined allowable width. Hence, nipping portion which is uniform and stable over its entire width (i.e., the axial direction of the rollers) can be formed.

The stretcher 4 is formed so as to assume the shape of a crown such that the longitudinal center portion thereof, over which the belt 3 slidably moves, become slightly bulged convexly, thereby rendering greater the tensile force "f" imparted to the belt 3 in the vicinity of the longitudinal center of the stretcher 4. With this configuration, the belt 3 is prevented from slipping toward either edge of the stretcher 4 or traveling in a meandering manner. Thus, the belt 3 can smoothly slide over the sliding face of the stretcher 4. The stretcher 4 can also be deformed so as to make a substantially straight sliding face while deformation of the stretcher is being regulated by the projection 4*g*. Forming the crown shape in the direction in which the belt 3 is lightly pressed against the heating roller 1 as well as in the stretching direction of the belt 3 is also effective for forming a stable nipping portion.

The stretcher 4 is located at a position where the belt 3 is wrapped around the heating roller 1 to thus form a nipping portion. The regulating wall 4*d* is provided upright at one end or both ends of the stretcher 4 and is to regulate slippage of the belt 3 by coming into contact with the same when the belt 3 has slipped in one direction. A spring 9 is provided on a frame of the regulating wall 4*d* of the stretcher 4 opposite the heating roller 1 and which, by spring restoration force, lightly presses the stretcher 4 from the inside of the belt 3 against the heating roller 1. The flat face 4*c* of the stretcher 4 is lightly pressed from the inside of the belt 3 against the heating roller 1 by the spring 9 and positioned after having come into slidable contact with the heating roller 1.

A relative positional relationship between the stretcher 4 and the heating roller 1 is determined such that the belt 3 is stretched between the pressing roller 2 and the stretcher 4 and tensile force is imparted to the belt 3. From the microscopic viewpoint, the stretcher 4 is not axially parallel to the heating roller 1. The stretcher 4 and the heating roller 1 are in a so-called skewed correlation, and the relative positional relationship between them is influenced by straightness such as a warpage or bending of the stretcher 4. In such a case, when the area of the, stretcher 4 which is lightly pressed against the heating roller 1 from the inside of the belt 3 assumes the form of a cylindrical curved face, there may often arise a case where the nipping portion arising in the area of the stretcher 4 which is lightly pressed against the heating roller 1 from the Inside of the belt 3 cannot be formed uniformly. However, when the area of the stretcher 4 that is lightly pressed against the heating roller 1 from the inside of the belt 3 is formed in the form of the flat face 4*c* as mentioned previously, unevenness in the nipping portion corresponding to that area can be lessened, and a preferable nipping portion can be readily formed.

If a stable nipping portion is formed in the area of the stretcher 4 that is lightly pressed, frictional sliding force developing between the belt 3 and the stretcher 4 is added in correspondence to the frictional sliding force stemming from the tensile force of the belt 3. When the belt 3 is driven by the pressing roller 2, a pressed continuous nipping portion, where the belt 3 wraps around the heating roller 1, can be formed in an intermediate area (an intermediate area of the nipping portion) between the area of the stretcher 4 that is lightly pressed against the heating roller 1 and the area where the pressing roller 2 presses the belt 3 to the heating roller 1. Consequently, a more stable nipping portion can be formed.

In order to stably drive the pressing roller 2 while the belt 3 is stretched between the pressing roller 2 and the stretcher 4, a frictional coefficient between the pressing roller 2 and the belt 3 is preferably set so as to become greater than that existing between the stretcher 4 and the belt 3. However, there may arise a case where the frictional coefficient becomes unstable by intrusion of extraneous matter or abrasion. In contrast, when setting is effected such that an angle over which the belt 3 is wrapped around the stretcher 4 is made smaller than an angle over which the belt 3 is wrapped around the pressing roller 2 and such that the diameter of the stretcher 4 becomes smaller than that of the pressing roller 2, the length over which the belt 3 slides on the stretcher 4 becomes shorter. As a result, influence of an unstable factor, such as deterioration with time or disturbance can be avoided, and the belt 3 can be stably driven by the pressing roller 2.

While a position where the stretcher 4 is lightly pressed against the heating roller 1 is taken as a nipping start position, the sheet medium S passes between the belt 3 and the heating roller 1. As a result, a nonfused toner image is fused. The sheet medium S is output In the direction of the tangential line L at a position, where the pressing roller 2 is pressed against the heating roller 1, is taken as a nipping end position.

Next, the structure for supporting the pressing roller 2 and the stretcher 4 will be described. As shown in FIG. 1B, both ends of the rotary shaft 2*a* of the pressing roller 2 are rotatably supported by side frames 7 by way of bearings 7*a*. Pivoting arms 6 are pivotably fitted to both sides of the rotary shaft 2*a* of the pressing roller 2, and a guide groove 8*a* is formed in the area of the pivoting arm 8 which contacts the stretcher 4. A guide section 4*h* is formed on each end of the stretcher 4 so as to stretch toward the pressing roller 2, and this guide section 4*h* is fitted into the guide groove 8*a* of the pivoting arm 8 by way of a spring 4*e*. The spring 4*e* urges, with spring restoration force, the stretcher 4 in a direction in which tensile force "f" is imparted to the belt 3 by wrapping the belt 3 around the heating roller 1. The stretcher 4 is configured such that the stretcher 4 is urged in a direction moving away from the pressing roller 2 by the spring 4*e*, to thus impart tensile force "f" to the belt 3.

In the embodiment, the line passing through the core axis of the spring 4*e* is taken as a line which extends from a core axis 2*b* of the rotary shaft 2*a* of the pressing roller 2 to a position 2*c* outwardly offset from the heating roller 1. As a result, the direction in which the stretcher 4 is urged is a direction in which the belt 3 is pressed against the heating roller 1 by a component force of the urging force. Consequently, the component force of the urging force imparted to the stretcher 4 is added to the pressing force used for lightly pressing the belt 3 against the heating roller 1. In the intermediate area (the intermediate area of the nipping portion) between the area where the stretcher 4 is pressed against the heating roller 1 and the area where the pressing roller 2 is pressed against the heating roller 1, a continuous nipping portion with the belt 3 being pressed against and wrapped around the heating roller 1 can be formed. Therefore, a more stable nipping portion can be formed.

As mentioned previously, the stretcher 4 fits into the inner peripheral face of the belt 3 and imparts the tensile force "f" to the belt 3 in cooperation with the pressing roller 2 and the supporter 5. To this end, the guide holes 4*a* are formed In the longitudinal ends of the inner peripheral face of the stretcher 4. Guide projections 5*c*, which are to be fitted into the respective guide holes 4*a*, are formed on the supporter 5. Support arms 5*g* are formed at the respective longitudinal ends of the supporter 5, and the support arms 5*g* are fittingly supported by the rotary shaft 2*a* of the pressing roller 2. A projection 5*b* having a curved face identical with that of the outer peripheral face of the pressing roller 2 is formed at a position in the longitudinal center portion of the supporter 5 while opposing the projection 4*g*.

With the above-described configuration, axial deflection or creeping deformation of the stretcher 4 can be prevented by the projection 4*g* of the stretcher 4 and the projection 5*b* of the supporter 5. As a result, the axial nonuniform state of the nipping portion can be mitigated, and a nipping portion which is uniform and stable over its entire width (i.e., the axial direction of the rollers) can be formed.

In the embodiment, the stretcher 4 is a non-rotational member which causes the belt 3 to slidably move. For this reason, a bearing or the like becomes unnecessary, and the support structure becomes simple. In addition, as a result of the stretcher 4 being formed into a substantially crescent shape, the stretcher 4 is disposed while a concave portion of the crescent shape faces toward the pressing roller 2, and hence the stretcher 4 can be arranged extremely close to the pressing roller 2. With this arrangement, the belt 3 can be configured while its circumferential length is shortened. Consequently, the heat-roll-type fusing device can be made compact and less expensive by being rendered simple in structure.

The belt 3 moves over the required minimum path. Hence, the belt 3 is heated by the nipping portion formed by the heating roller 1 which incorporates the heat source and is rotatable. Thereby, the heat energy during the course of traveling over the predetermined path can be minimized. Moreover, the circumferential length of the belt 3 can be shortened, and hence a temperature drop due to natural radiation is small. The so-called warm-up time that elapses from when power is turned on until the belt is heated to a predetermined temperature and enables fusing operation can be shortened. Moreover, the belt 3 is wrapped around the heating roller 1 while being imparted with the tensile force by cooperation of the pressing roller 2 and the stretcher 4, to thus form a nipping portion. Hence, the length of the nipping portion (i.e., the circulating direction of the belt) can readily be made long, thereby rendering the structure of the fusing device simple, compact, and less expensive.

In order to stably fuse the nonfused toner image formed on the sheet medium S, sufficient fusion of the nonfused image is indispensable, and a desired temperature and a desired fusing time are required. According to the configuration of the embodiment, the belt 3 is stretched by the stretcher 4 and wrapped around the heating roller 1 while tensile force is imparted to the belt 3, to thus form a nipping portion. The pressing roller 2 which presses the belt 3 from the inside thereof is used for pressing the belt 3, and the belt 3 is lightly pressed by the stretcher 4, thereby rendering the length of the nipping portion long. This negates the necessity for means for rendering the length of the nipping portion long by greatly distorting the elastic body covering the face of the heating roller 1, and hence the thickness of the elastic body can be made small. Moreover, there is no necessity for setting high the compression force of the pressing roller 2 for distorting the elastic body. Stress imposed on the sheet medium S when the sheet medium S carrying the nonfused toner image passes between the heating roller 1 and the belt 3 is small. Therefore, deformation of the sheet medium S, such as occurrence of wrinkles in the sheet medium S output after fusion of the nonfused toner image, is prevented.

Therefore, a necessity for an increase in the mechanical rigidity of the heat-roller-type fusing device is obviated, and the heating roller 1 can be made thin, whereby the speed at which the belt 3 is heated by the heat source is improved. Similarly, the pressing roller 2 can also be made thin, and the heat capacity of the roller can be made small. Accordingly, the amount of heat energy taken out of the belt 3 is small, and the so-called warm-up time that lapses from when power is turned on until when fusion becomes feasible as a result of the temperature having reached a desired level can be shortened.

Figure 4:
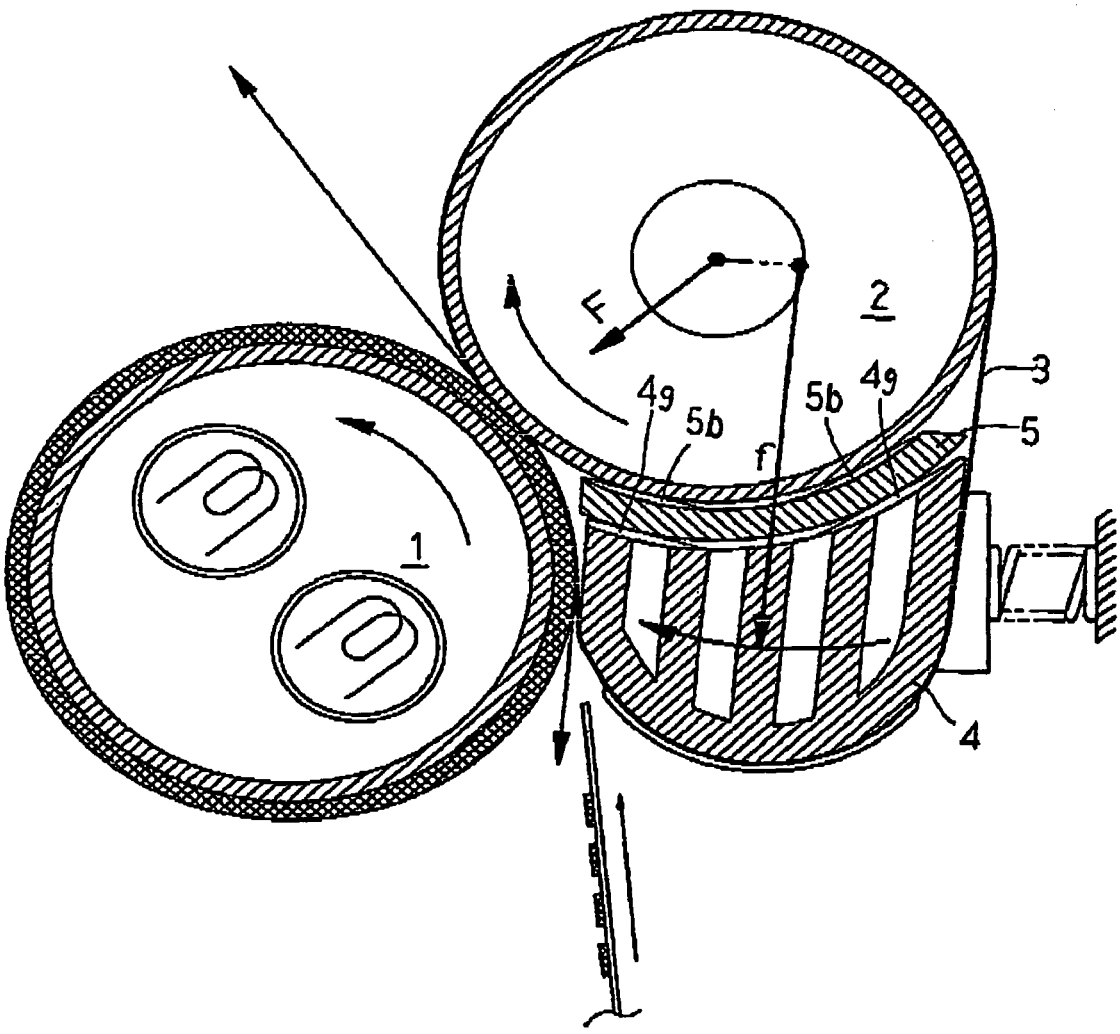
FIG. 4 is a section view of a fusing device according to a second embodiment of the invention.

FIG. 4 shows a fusing device according to a second embodiment of the invention. Components similar to those in the first embodiment are designated by the same reference numerals and repetitive explanations for those will be omitted.

In this embodiment, a pair of projections 4*g* each having a rounded contact face are formed on a face of the stretcher 4 facing the supporter 5 at both ends in the circumferential direction of the pressing roller 2. Further, a pair of projections 5*b* each having a rounded contact face are formed on a face of the supporter 5 facing the pressing roller 2 at both ends in the circumferential direction of the pressing roller 2. The projections 4*g* come into slidable contact with the supporter 5 so that the stretcher 4 is brought into slide contact with the supporter 5 with a resultant vector force obtained by the slide contact of the projections 4*g*. The projections 5*b* come into slidable contact with the pressing roller 2 so that the supporter 5 is brought into slide contact with the pressing roller 2 with a resultant vector force obtained by the slide contact of the projections 5*b*.

Figure 5A:
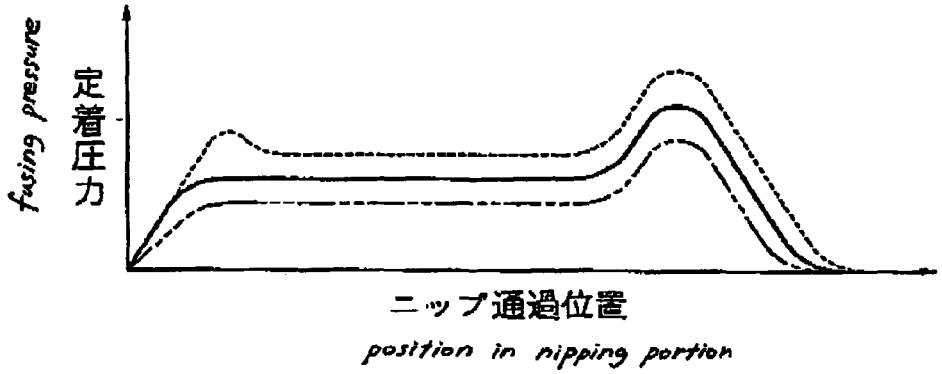
FIGS. 5A to 5C are graphs showing a relationship between a position in the nipping portion and a fusing pressure in various conditions.
Figure 5B:
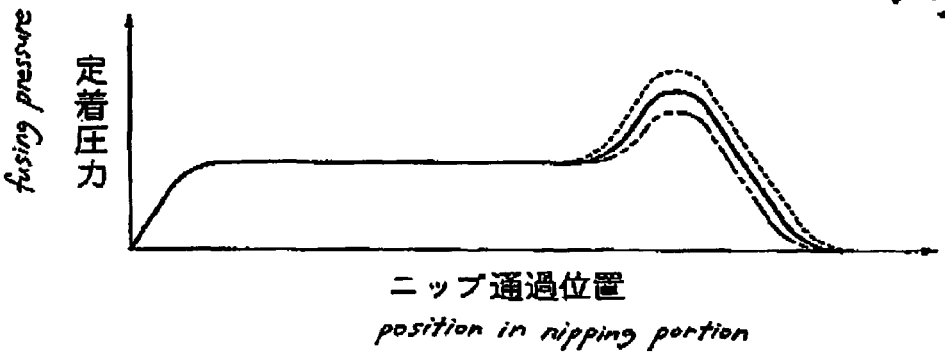
Figure 5C:
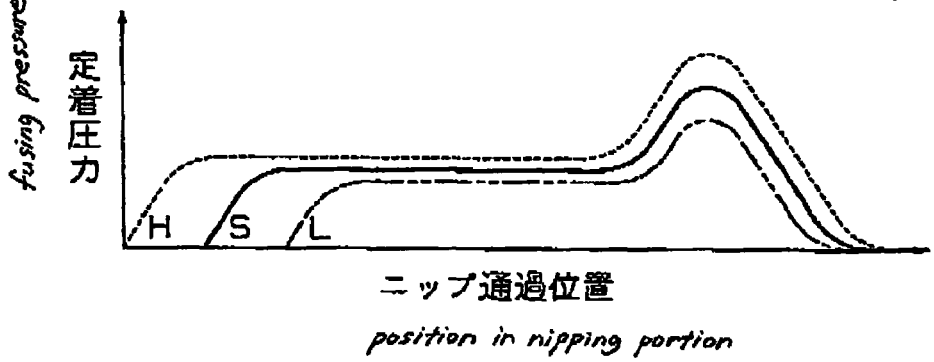

FIGS. 5A to 5C are views showing variations in a position where the belt passes through the nipping portion (hereinafter called a "position in the nipping portion") and a change in fusing pressure when the stretcher 4 is disposed upstream in the moving direction of the belt 3. Dashed lines denote variations in fusing pressure achieved In the case of a thick sheet medium; solid lines denote variations in fusing pressure achieved in the case of a sheet medium having a standard thickness; and dashed chain lines denote variations in fusing pressure achieved in the case of a thin sheet medium.

In a case where the stretcher 4 is disposed upstream with respect to the moving direction of the belt 3, when the stretcher 4 is lightly pressed against the heating roller 1, the fusing pressure of the thick sheet medium achieved at the nipping start position is increased as shown in FIG. 5A. In general, a difference arises in the fusing pressure according to the thickness of the sheet medium. However, constant fusing pressure is achieved from the nipping start position in the nipping portion, and the fusing pressure is increased at the nipping end position by the pressing action of the pressing roller 2. As shown in FIG. 5B, a predetermined fusing pressure is achieved, regardless of the thickness of the sheet medium by making the stretcher 4 pivotable. As shown in FIG. 5C, in a case where the nipping start position is changed by changing the position of the stretcher 4 to thus change the length for which the belt 3 is wrapped around the heating roller 1 (the length of the nipping portion), pressure difference may arise but becomes smaller.

According to the embodiment, since the belt 3 is moved over the minimum-required path, the belt 3 is heated by the nipping portion formed between the pressing roller 2 and the heating roller 1 which houses the heat source and is rotatable. The thermal energy lost during movement of the belt 3 along the predetermined path can be minimized. The circumferential length of the heat-resistant belt can also be shortened. Hence, a drop in temperature due to natural radiation is small, and the so-called warm-up time that elapses from when power is turned on until when fusion becomes feasible as a result of the temperature having reached a desired level can be shortened.

Figure 6:
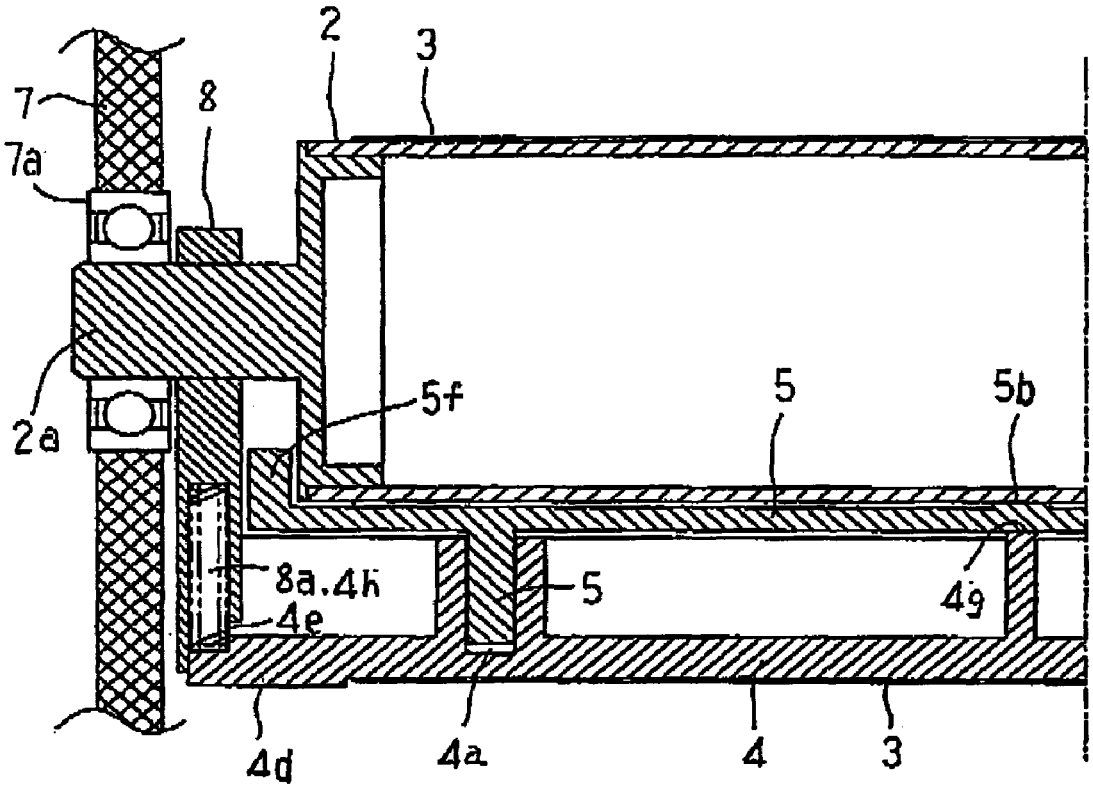
FIG. 6 is a section view of a fusing device according to a third embodiment of the invention.

FIG. 6 shows a fusing device according to a third embodiment of the invention. Components similar to those in the first embodiment are designated by the same reference numerals and repetitive explanations for those will be omitted.

In this embodiment, flanges 5*f* are provided upright on the longitudinal ends of the supporter 5. The position of the supporter 5 in the axial direction of the pressing roller 2 is secured by the flanges 5*f* even though the supporter 5 is supported by the rotary shaft 2*a* as in the first embodiment.

FIGS. 7A and 7B show a fusing device according to a fourth embodiment of the invention. Components similar to those in the first embodiment are designated by the same reference numerals and repetitive explanations for those will be omitted.

In this embodiment, as shown in FIG. 7A, the stretcher 4 is disposed so as to be pivotable in the direction of arrow P about the rotary shaft 2*a* of the pressing roller 2.

Figure 9:
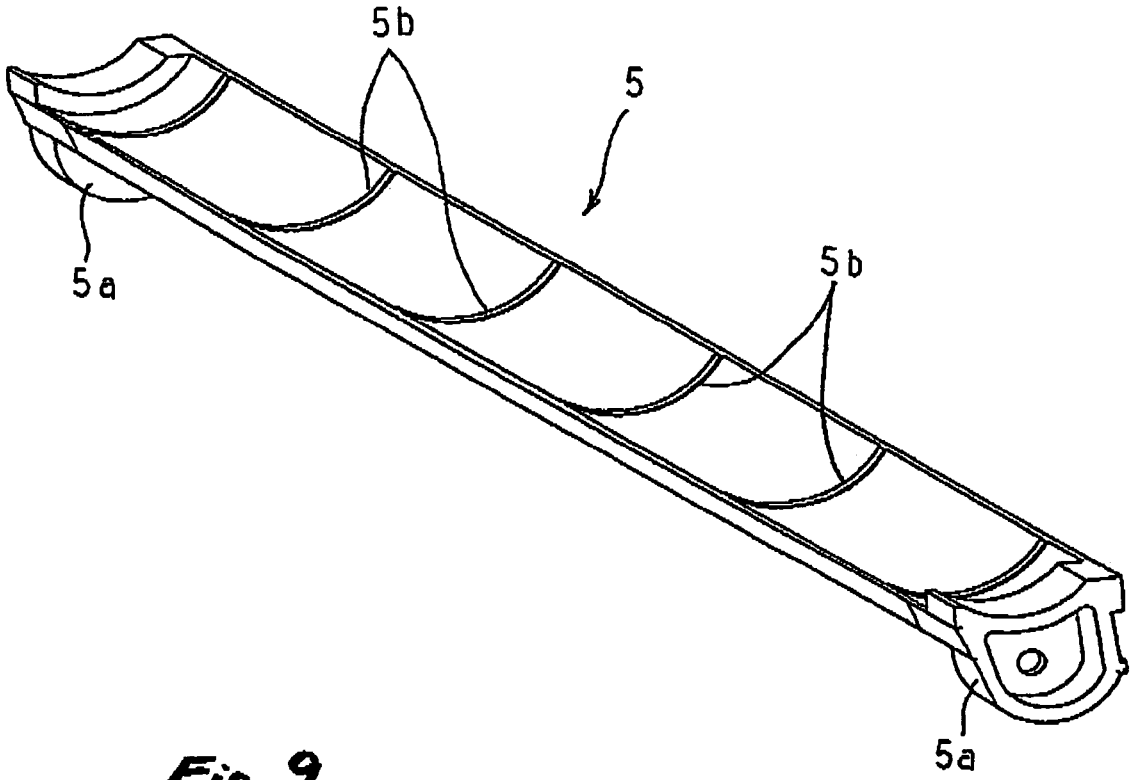
FIG. 9 is a perspective view of a supporter in the fusing device of FIG. 7A.

As shown in FIG. 9, the supporter 5 is a member having a arcuate cross section relative to the axial direction of the pressing roller 2. A flange 5*a* extending to both the pressing roller 2 and the stretcher 4 is formed at each longitudinal end of the supporter 5.

Figure 8:
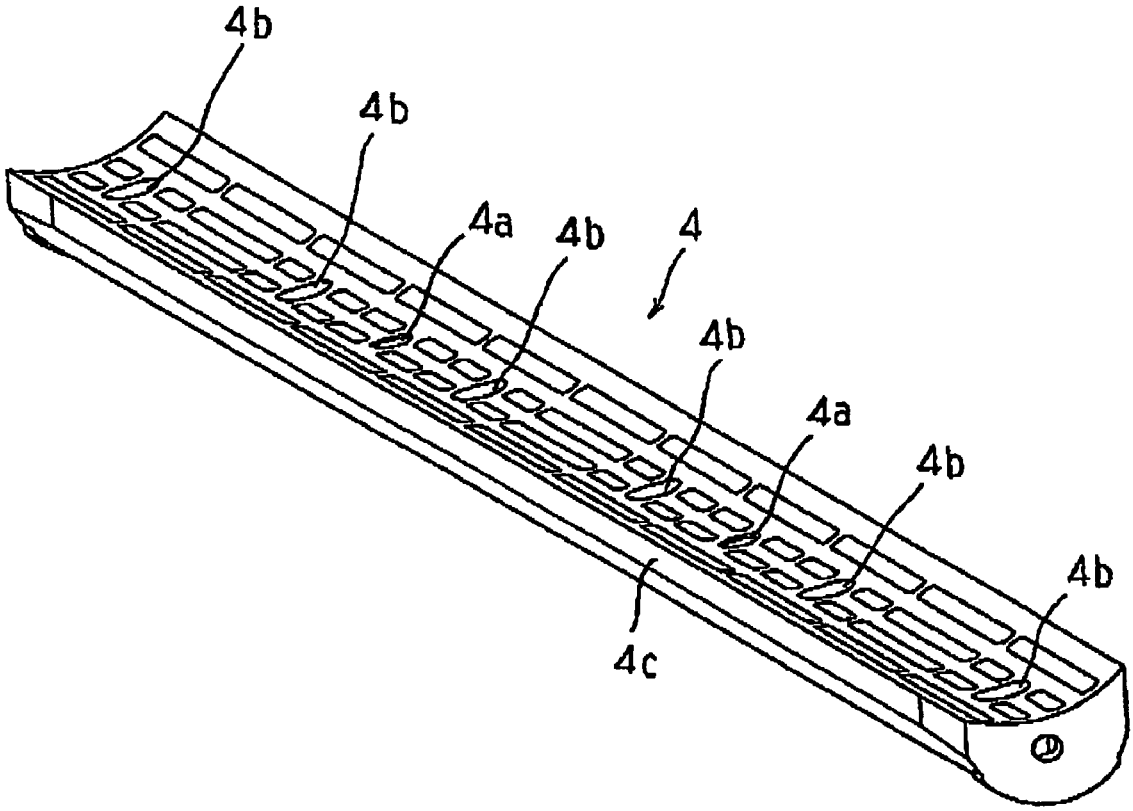
FIG. 8 is a perspective view of a stretcher in the fusing device of FIG. 7A.

As shown in FIG. 7B, a plurality of guide projections 5*c* are arrayed on an outer peripheral face of the supporter 5 in the longitudinal direction thereof. As shown in FIG. 8; guide holes 4*a* are formed at positions on the inner peripheral face of the stretcher 4 so as to correspond to the guide members 5*c*. Spring holes 4*b* are formed at positions opposing the projections 5*b*. Springs 6 are provided in the respective spring holes 4*b*. The pressure roller 2 and the stretcher 4 are arranged so as to be situated between the flanges 5*a* of the supporter 5. The guide member 5*c* of the supporter 5 is fitted into the guide hole 4*a*, thereby positioning the supporter 5 and the stretcher 4 with respect to the pressure roller 2. With this configuration, the tensile force corresponding to the urging force of the respective springs 6 acts on the stretcher 4, thereby imparting tensile force "f" to the belt 3.

The belt 3 which is passed around the outer peripheral face of the pressing roller 2 and travels while being nipped between the pressing roller 2 and the heating roller 1 is tensioned by the stretcher 4 to be wrapped around the heating roller 1, thereby forming a nipping portion. In this case, there may arise a case where axial deflection occurs in the stretcher 4 or where creeping deformation arises under influence of the heating roller 1 which is heated to a temperature as high as about 200° C. Particularly, when the stretcher 4 is formed from a plastic material having low thermal capacity, on the assumption that the stretcher is effective for shortening a warm-up time, the phenomenon of occurrence of deflection or deformation has become noticeable, which is not preferable for forming a stable nipping portion.

In the embodiment, the tensile force corresponding to the urging force of the respective springs 6 acts on the stretcher 4 over the entire axial area thereof. Therefore, occurrence of such axial deflection or creeping deformation can be prevented by a clearance having a predetermined allowable width, and, hence, a nipping portion which is uniform and stable over its entire width (i.e., the axial direction of the rollers) can be formed.

With this configuration that the plurality of springs 6 are interposed between the stretcher 4 and the supporter 5, to thus impart tensile force to the belt 3, the distribution of axial fusing pressure of the stretcher 4 is variously selectable according to a combination or selection of the urging forces of the plurality of springs 6, and the only requirement is to select the distribution of fusing pressure according to an object.

FIG. 11A shows a selective layout where the urging forces of the plurality of springs 6 form a uniform distribution of fusing pressure. A nonfused toner image formed on a sheet medium is caused to pass through the nipping portion, whereupon the toner image is fused. At this time, a fusing characteristic, such as fusing strength, a fusing gloss, or the like, is dependent on the temperature and pressure of the nipping portion. Accordingly, a fused image having a uniform fusing characteristic over the entire sheet can be obtained by forming a uniform distribution of fusing pressure.

FIG. 11B is a selective layout where the urging forces of the plurality of springs 6 are arranged such that a distribution of low fusing pressure is acquired at both longitudinal ends of the stretcher and such that a distribution of high fusing pressure is achieved in the longitudinal center of the same. When axial deflection arises in the heating roller 1, the pressing roller 2, and the stretcher 4, the fusing pressure in the center of the stretcher is undesirably decreased. However, the urging forces of the plurality of springs 6 are set such high urging force is achieved in the longitudinal center of the stretcher 4, whereby a fusing image which has a uniform fusing characteristic over the entirety of the sheet medium can be obtained.

FIG. 11C is a selective layout where the urging forces of the plurality of springs 6 are arranged such that a distribution of high fusing pressure is acquired at both longitudinal ends of the stretcher and such that a distribution of low fusing pressure is achieved in the longitudinal center of the same. When the nonfused toner image formed on the sheet medium is caused to pass through the nipping portion, where the toner image is fused, wrinkles or the like undesirably arise in the center of the sheet medium depending on a balance between the fusing pressure and the force for transporting the sheet medium.

In general, a pair of rollers, each having the shape of a reversed crown; that is, a shape in which the outer diameter of the pressing roller or that of the heating roller at the longitudinal center portion is made small, are used, to thus increase the ability to transport the sheet medium at both longitudinal ends. In this embodiment, the urging forces of the plurality of springs 6 are set such that the forces become high at both longitudinal ends of the stretcher 4 and become low at the longitudinal center of the same. As a result, the ability to transport the sheet medium at both longitudinal ends can be increased so that the same advantageous effect can be obtained as in the case where the rollers having the reversed-crown shape are used.

FIG. 11D shows a case where the urging forces of the plurality of springs 6 are set so as to become high at both longitudinal ends and the longitudinal center of the stretcher 4. The plot has a distribution of fusing pressure which is a combination of that shown in FIG. 11B and that shown in FIG. 11C. The fusing pressure achieved in the longitudinal center can be increased, to thus enhance the sheet transport ability.

Figure 10:
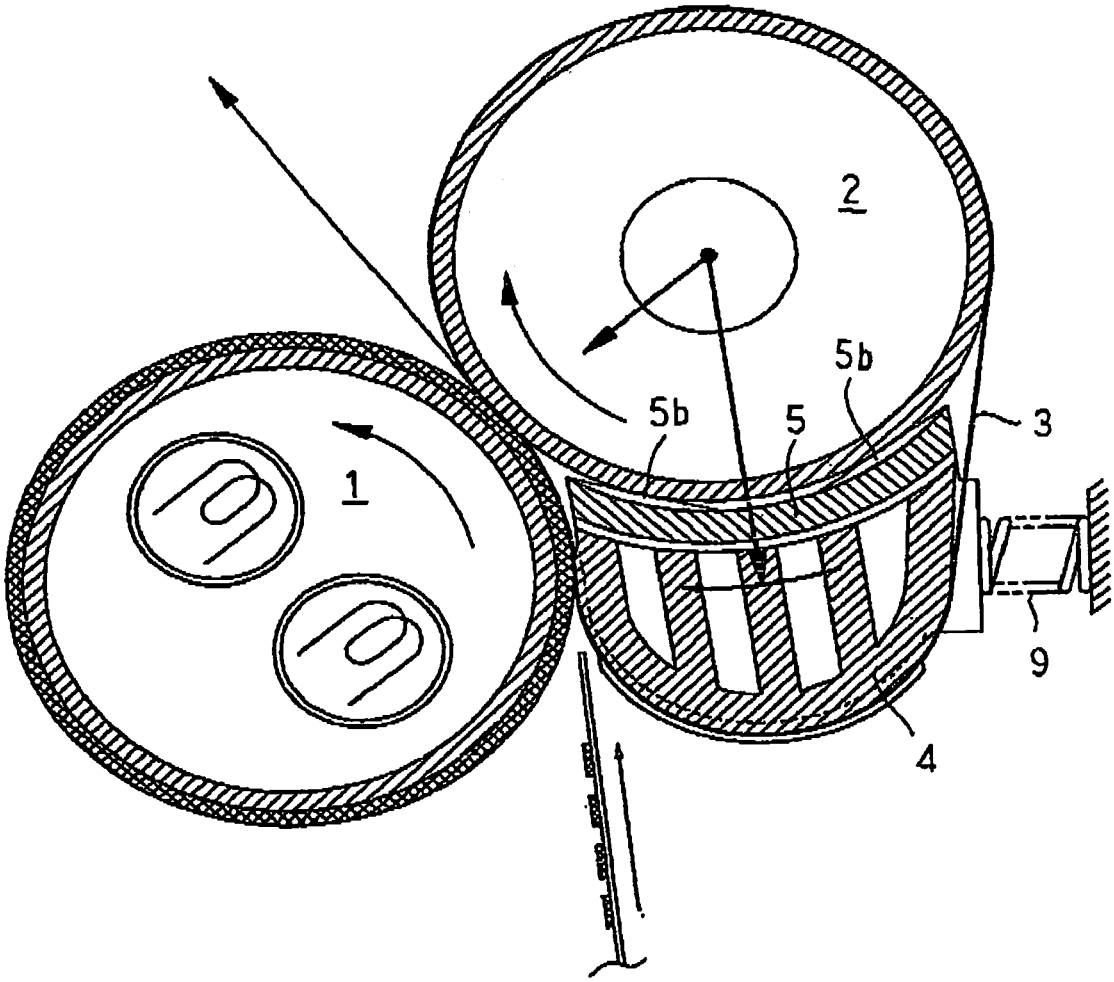
FIG. 10 is a section view of a fusing device according to a fifth embodiment of the invention.

FIG. 10 shows a fusing device according to a fifth embodiment of the invention. Components similar to those in the fourth embodiment are designated by the same reference numerals and repetitive explanations for those will be omitted.

In this embodiment, a pair of projections 5*b* each having a rounded contact face are formed on a face of the supporter 5 facing the pressing roller 2 at both ends in the circumferential direction of the pressing roller 2. The projections 5*b* come into slidable contact with the pressing roller 2 so that the supporter 5 is brought into slide contact with the pressing roller 2 with a resultant vector force obtained by the slide contact of the projections 5*b*.

FIGS. 12A and 12B show a fusing device according to a sixth embodiment of the invention. Components similar to those in the fourth embodiment are designated by the same reference numerals and repetitive explanations for those will be omitted. In this embodiment, the stretcher 4 is disposed downstream of the nipping portion with respect to the moving direction of the belt 3.

Figure 13:
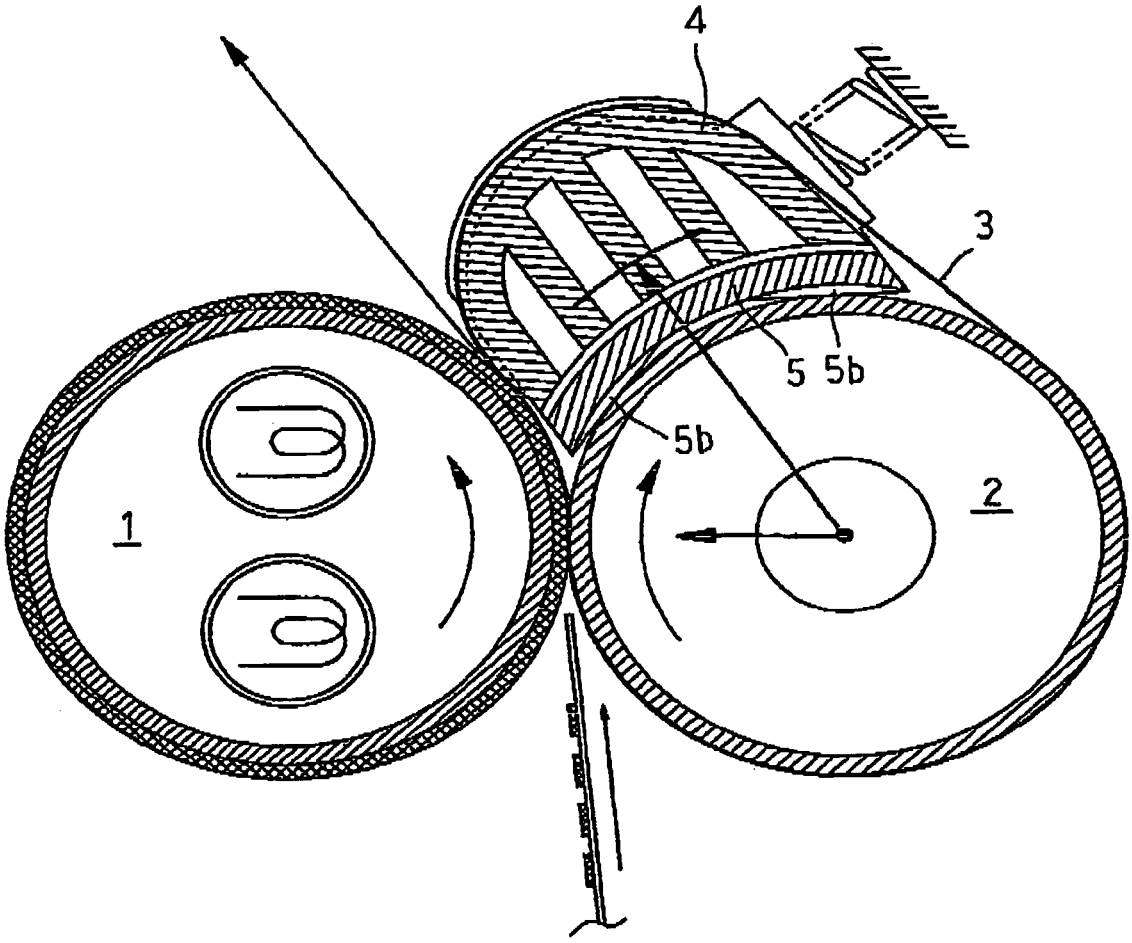
FIG. 13 is a section view of a fusing device according to a seventh embodiment of the invention.

FIG. 13 shows a fusing device according to a seventh embodiment of the invention. Components similar to those in the sixth embodiment are designated by the same reference numerals and repetitive explanations for those will be omitted.

In this embodiment, a pair of projections 5*b* each having a rounded contact face are formed on a face of the supporter 5 facing the pressing roller 2 at both ends in the circumferential direction of the pressing roller 2. The projections 5*b* come into slidable contact with the pressing roller 2 so that the supporter 5 is brought into slide contact with the pressing roller 2 with a resultant vector force obtained by the slide contact of the projections 5*b*.

FIGS. 14A and 14B show a fusing device according to an eighth embodiment of the invention. Components similar to those in the fourth embodiment are designated by the same reference numerals and repetitive explanations for those will be omitted.

In this embodiment, the line passing through the core axis of the spring 6 is taken as a line which extends through the position 2*c* of the pressing roller 2 which is offset from the core axis 2*b* of the rotary shaft 2*a* of the pressing roller 2. As a result, the direction in which the stretcher 4 is urged is a direction in which the belt 3 is pressed against the heating roller 1 by a component force of the urging force. Consequently, the component force of the urging force imparted to the stretcher 4 is added to the pressing force used for lightly pressing the belt 3 against the heating roller 1. In the intermediate area (the intermediate area of the nipping portion) between the area where the stretcher 4 is pressed against the heating roller 1 and the area where the pressing roller 2 is pressed against the heating roller 1, a continuous nipping portion with the belt 3 being pressed against and wrapped around the heating roller 1 can be formed. Therefore, a more stable nipping portion can be formed.

In the intermediate area of the nipping portion, if the force for pressing the belt 3 against the heating roller 1 becomes deficient or unstable, there may arise a case where stable, preferable fusing cannot be performed in the case of, particularly, a thick sheet material or the like. For this reason, as in the case of the present embodiment, the stretcher 4 is pressed by the flat face 4*c*, and the component force of tensile force and the frictional force are added to the force as pressing force. As a result, the belt 3 is positively wrapped around the heating roller 1 in the intermediate area of the nipping portion, so that a stable, pressed, continuous nipping portion can be formed. Thus, unstable state can be lessened, and a preferable nipping portion can be formed.

Figure 15:
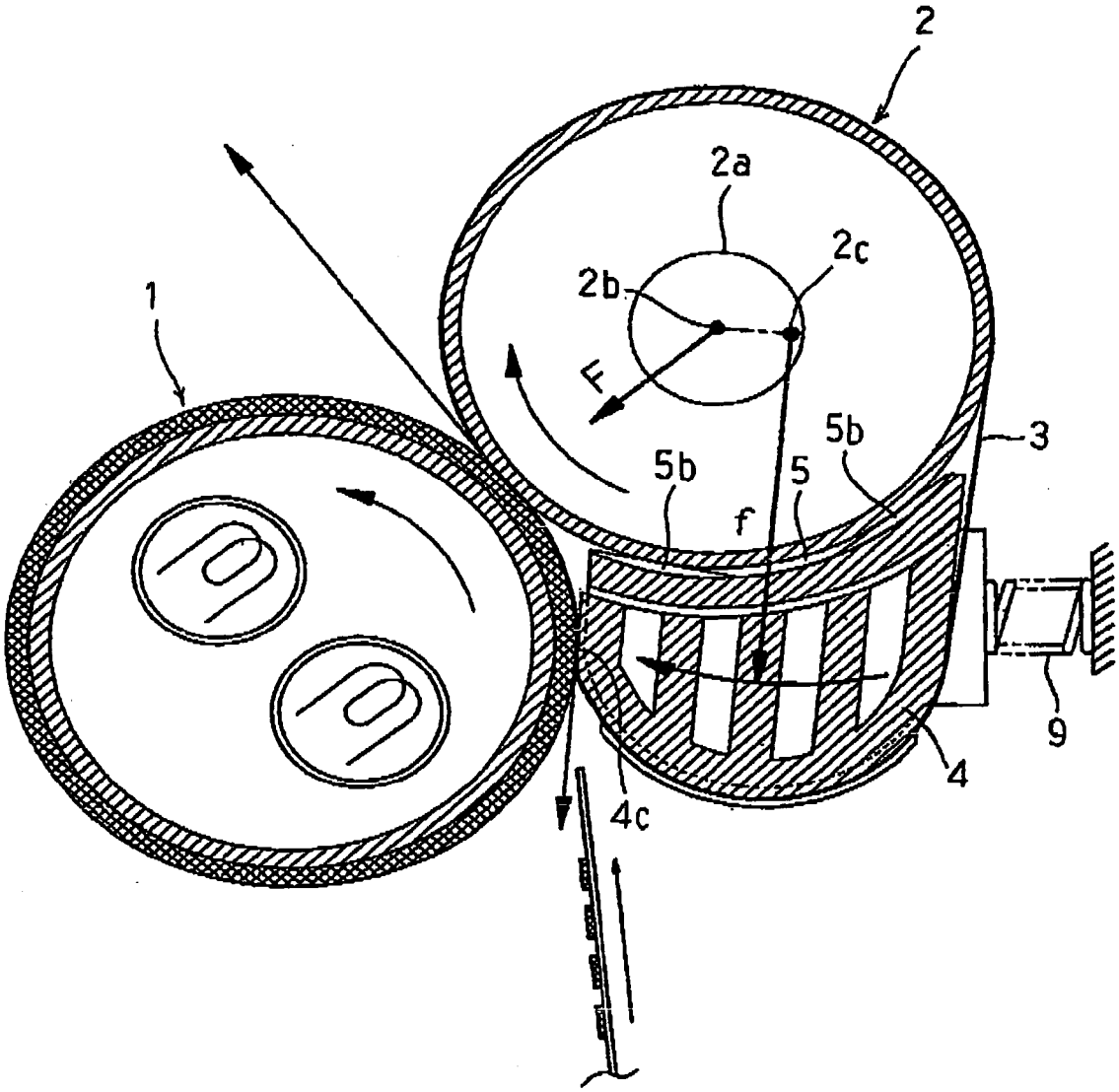
FIG. 15 is a section view of a fusing device according to a ninth embodiment of the invention.

FIGS. 15A and 15B show a fusing device according to a ninth embodiment of the invention. Components similar to those in the eighth embodiment are designated by the same reference numerals and repetitive explanations for those will be omitted.

In this embodiment, a pair of projections 5*b* each having a rounded contact face are formed on a face of the supporter 5 facing the pressing roller 2 at both ends in the circumferential direction of the pressing roller 2. The projections 5*b* come into slidable contact with the pressing roller 2 so that the supporter 4 is brought into slide contact with the pressing roller 2 with a resultant vector force obtained by the slide contact of the projections 5*b*.

FIGS. 16A and 16B show a fusing device according to a tenth embodiment of the invention. Components similar to those in the fourth embodiment are designated by the same reference numerals and repetitive explanations for those will be omitted.

Figure 17:
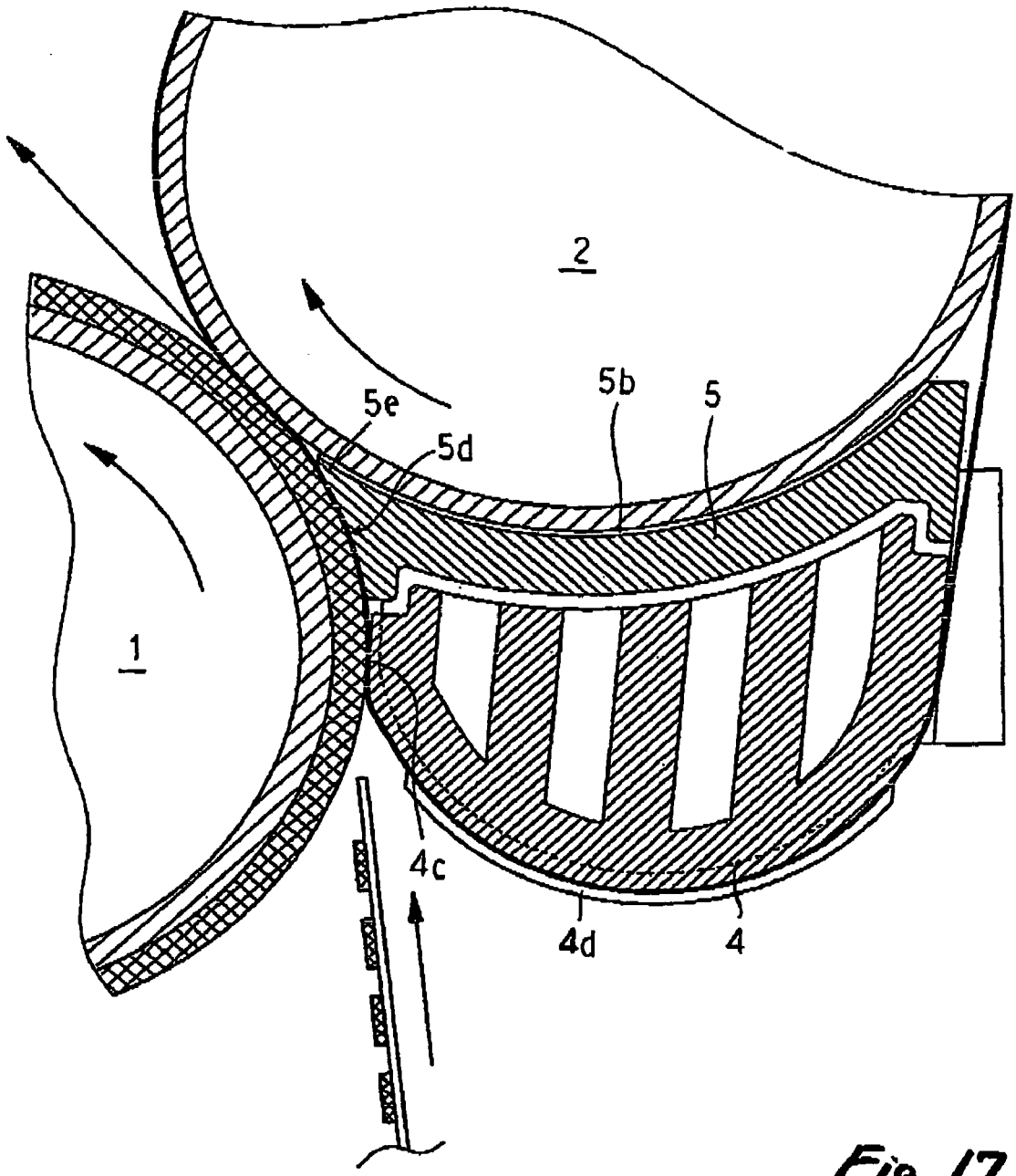
FIG. 17 is an enlarged section view of a nipping portion in the fusing device of FIG, 16A.

In this embodiment, the supporter 5 is provided with a pressing member 5*d* having a curved surface whose curvature radius is identical with the curvature radius including the total thickness of the heating roller 1 and the belt 3 and opposes the heating roller 1. An extremity 5*e* of the pressure member 5*d* is made close to the nipping portion as shown in FIG. 17.

Besides, the guide projections 5*c* of the supporter 5 and the associated guide holes 4*a* of the stretcher 4 in the fourth embodiment are omitted. Therefore, only the spring holes 4*b* are arrayed at positions opposing the projections 5*b*.

With this configuration, the tensile force corresponding to the urging force of the respective springs 6 acts on the stretcher 4, thereby imparting tensile force "f" to the belt 3. Concurrently, the rotational force of the pressing roller 2 is transmitted to the supporter 5 by the frictional force stemming from the projections 5*b*.

If a stable nipping portion is formed in the area of the stretcher 4 that is lightly pressed, frictional sliding force developing between the belt 3 and the stretcher 4 is added in correspondence to the frictional sliding force stemming from the tensile force of the belt 3. When the belt 3 is driven by the pressing roller 2, the pressing member 5*d* of the supporter 5 assists to wrap the belt 3 around the heating roller 1 at an intermediate area of the nipping portion between the area of the stretcher 4 lightly presses the belt 3 against the heating roller 1 and the area where the pressing roller 2 presses the belt 3 against the heating roller 1. Consequently, a more stable nipping portion can be formed.

Figure 18:
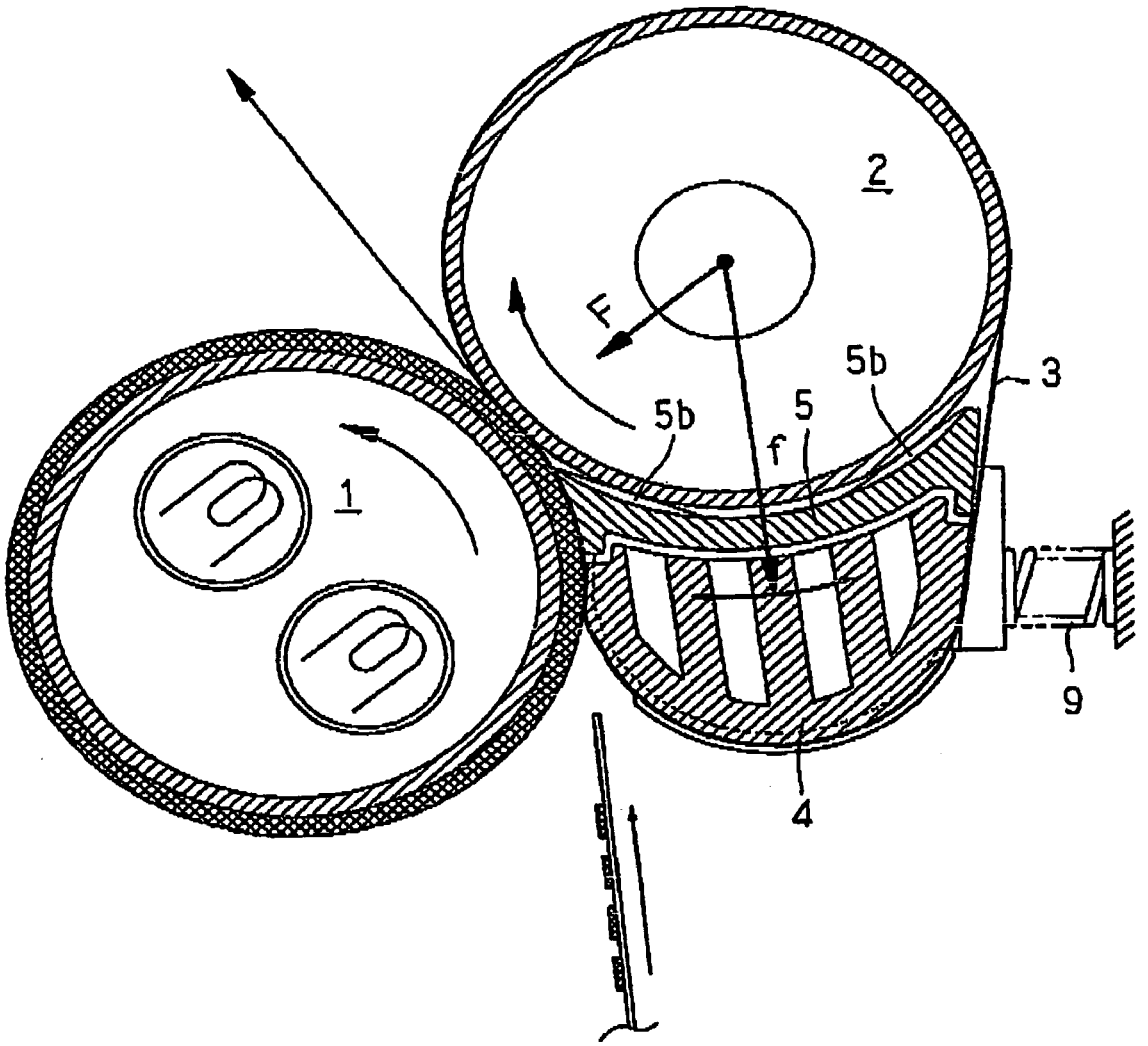
FIG. 18 is a section view of a fusing device according to an eleventh embodiment of the invention.

FIG. 18 shows a fusing device according to an eleventh embodiment of the invention. Components similar to those in the tenth embodiment are designated by the same reference numerals and repetitive explanations for those will be omitted.

In this embodiment, a pair of projections 5*b* each having a rounded contact face are formed on a face of the supporter 5 facing the pressing roller 2 at both ends in the circumferential direction of the pressing roller 2. The projections 5*b* come into slidable contact with the pressing roller 2 so that the supporter 4 is brought into slide contact with the pressing roller 2 with a resultant vector force obtained by the slide contact of the projections 5*b*.

FIGS. 14A and 14B show a fusing device according to a twelfth embodiment of the invention. Components similar to those in the tenth embodiment are designated by the same reference numerals and repetitive explanations for those will be omitted.

In this embodiment, the line passing through the core axis of the spring 6 is taken as a line which extends through the position 2*c* of the pressing roller 2 which is offset from the core axis 2*b* of the rotary shaft 2*a* of the pressing roller 2. As a result, the direction in which the stretcher 4 is urged is a direction in which the belt 3 is pressed against the heating roller 1 by a component force of the urging force. Consequently, the component force of the urging force imparted to the stretcher 4 is added to the pressing force used for lightly pressing the belt 3 against the heating roller 1. In the intermediate area (the intermediate area of the nipping portion) between the area where the stretcher 4 is pressed against the heating roller 1 and the area where the pressing roller 2 is pressed against the heating roller 1, a continuous nipping portion with the belt 3 being pressed against and wrapped around the heating roller 1 can be formed. Therefore, a more stable nipping portion can be formed.

FIGS. 20A and 20B show a fusing device according to a thirteenth embodiment of the invention. Components similar to those in the fourth embodiment are designated by the same reference numerals and repetitive explanations for those will be omitted.

In this embodiment, the stretcher 4 is disposed so as to be pivotable in the direction of arrow P about the rotary shaft 2*a* of the pressing roller 2 so that the stretcher 4 can be retractably brought in to light press contact with the heating roller 1 through the belt 3, as in the first embodiment.

A cleaning member (omitted from the drawings) is interposed between the pressing roller 2 and the stretcher 4 as a member which cleans extraneous matter, abrasion dust, or the like, from the inner peripheral face of the belt 3 when coming into slidable contact therewith, thereby eliminating unstable factors. An indented section suitable for housing the thus-eliminated extraneous matter, abrasion dust, or the like can be provided in the stretcher 4.

The structure for supporting the pressing roller 2 and the stretcher 4 is realized such that, as shown in FIG. 20B, the ends of the rotary shaft 2*a* of the pressing roller 2 are rotatably supported by right and left frames 7 by way of bearings 7*a*. Pivoting arms 8 are pivotably fitted to the respective sides of the rotary shaft 2*a* of the pressing roller 2, and a guide groove 8*a* is formed in the area of the pivoting arm 8 which contacts the stretcher 4. A guide section 4*h* is formed on each end of the stretcher 4 so as to extend toward the pressing roller 2, and this guide section 4*h* is fitted into the guide groove 8*a* of the pivoting arm 8 by way of the spring 4*e*.

In a case where the belt 3 is tensioned by the stretcher 4 in the direction, in which the belt 3 is wrapped around the heating roller 1 with reference to the tangential line of the press contact position defined between the heating roller 1 and the pressing roller 2, to thus form nipping portion, a determination is made as to whether the stretcher 4 is retracted from the heating roller 1 or the stretcher 4 is lightly pressed against the heating roller 1 through the belt 3, by adjusting, at least, the urging force of the spring 4*e* which imparts tensile force, the urging force of the spring 9 which lightly presses the stretcher 4 from the inside of the belt 3 toward the heating roller 1, the orientations of the urging forces, and the positions of the springs.

For example, when the urging force attributable to the spring 4*e* is made greater while the stretcher 4 is lightly pressed against the heating roller 1 from the inside of the belt 3, the stretcher 4 is separated from the heating roller 1 against the pressing force of the spring 9. When the urging force of the spring 9 is made smaller, the tensile force of the belt 3 attributable to the spring 4*e* becomes relatively greater, whereby the stretcher 4 is separated from the heating roller 1. Moreover, when the stretching direction in which urging force is applied by the spring 4*e* is switched to a direction moving away from the tangential line along which the stretcher 4 is lightly pressed against the heating roller 1, a component of the tensile force of the belt 3 and the urging force of the spring 4*e*, both of which cancel out the pressing force originating from the spring 9, become greater. Therefore, the stretcher 4 is separated from the heating roller 1. When the position where urging force is applied by the spring 9 is caused to approach the pivot center of the pivoting arms 8, the pressing force is made relatively smaller, whereby the stretcher 4 is separated from the heating roller 1.

Figure 21:
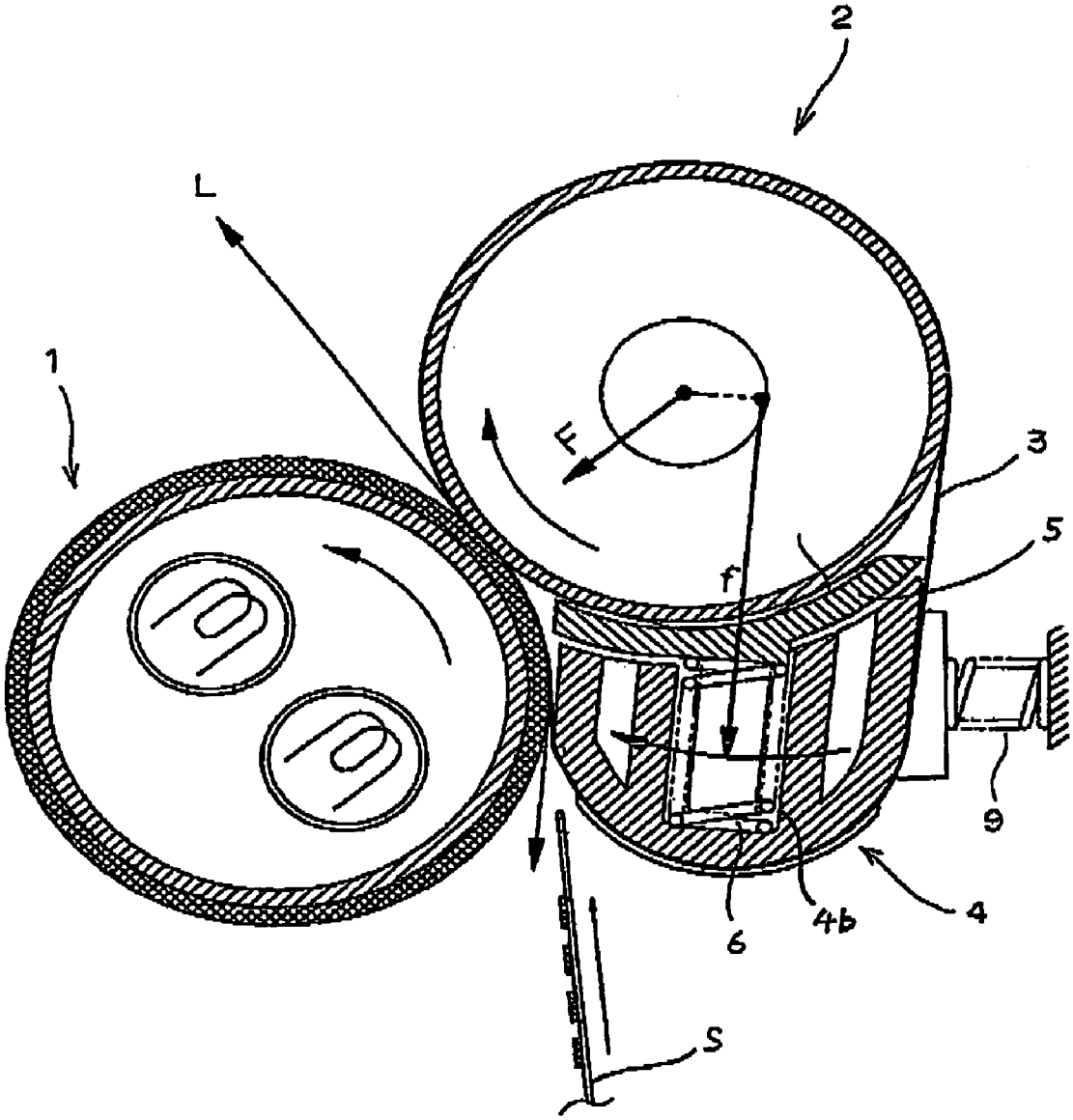
FIG. 21 is a section view of a fusing device according to a fourteenth embodiment of the invention.

FIG. 21 shows a fusing device according to a fourteenth embodiment of the invention. Components similar to those in the thirteenth embodiment are designated by the same reference numerals and repetitive explanations for those will be omitted.

In this embodiment, a pair of projections 5*b* each having a rounded contact face are formed on a face of the supporter 5 facing the pressing roller 2 at both ends in the circumferential direction of the pressing roller 2. The projections 5*b* come into slidable contact with the pressing roller 2 so that the supporter 4 is brought into slide contact with the pressing roller 2 with a resultant vector force obtained by the slide contact of the projections 5*b*.

Figure 22:
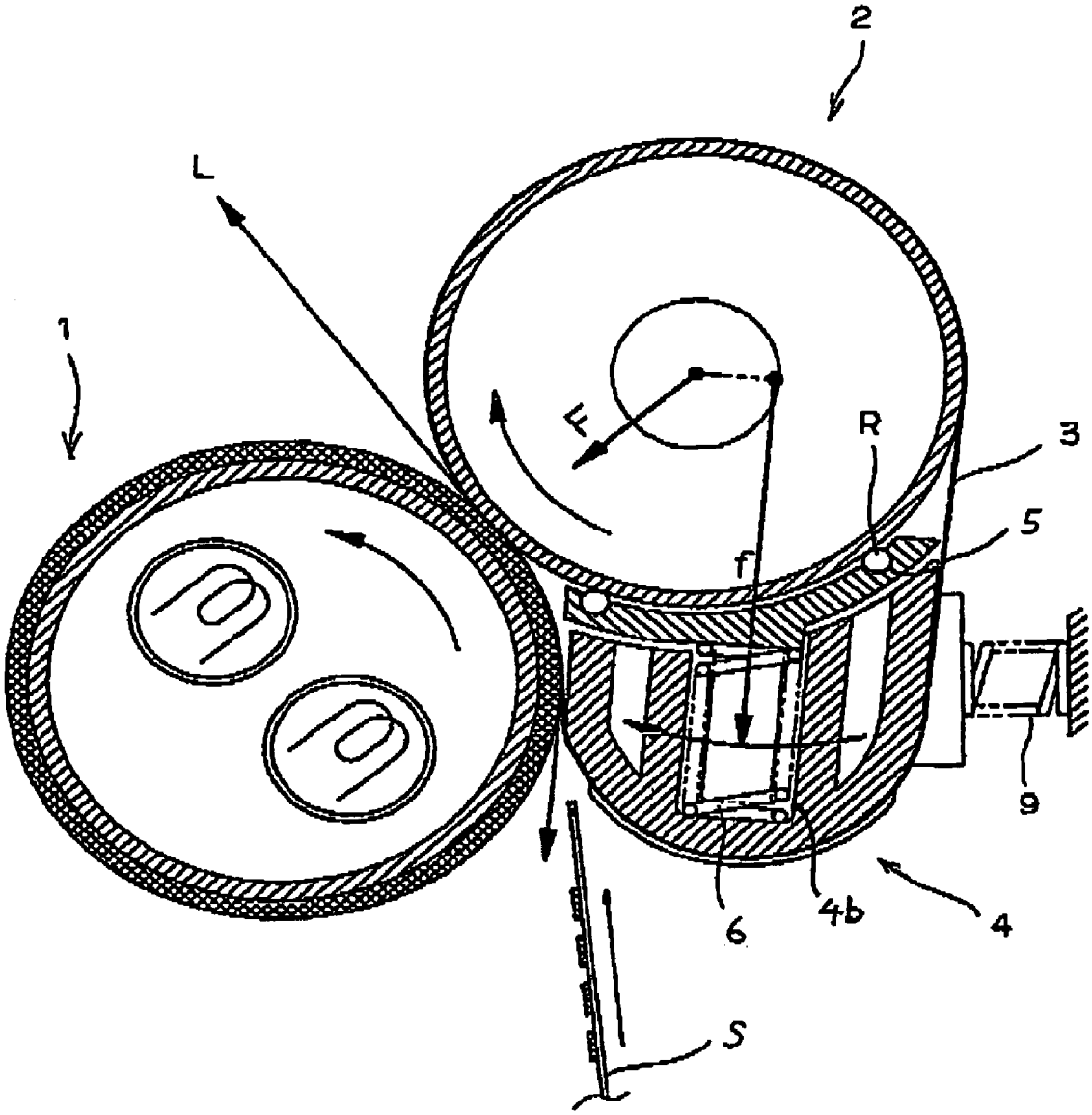
FIG. 22 is a section view of a fusing device according to a fifteenth embodiment of the invention.

FIG. 22 shows a fusing device according to a fifteenth embodiment of the invention. Components similar to those in the fourteenth embodiment are designated by the same reference numerals and repetitive explanations for those will be omitted.

In this embodiment, a plurality of rollers R which are driven and rotated upon contact with the outer peripheral face of the pressing roller 2 are provided instead of the projections 5*b* in the thirteenth embodiment. The rollers R may be provided with elastic members provided on bearings for the rollers.

FIGS. 23A and 23B show a fusing device according to a sixteenth embodiment of the invention. Components similar to those in the thirteenth embodiment are designated by the same reference numerals and repetitive explanations for those will be omitted.

In this embodiment, the stretcher 4 is pivotable over a predetermined angle about a shaft 7*b* which is different from the rotary shaft 2*a* of the pressing roller 2 but is in the vicinity of the axial center of the rotary shaft 2*a*.

Specifically, the pivoting arms 8 are pivotably fitted around both sides of the shaft 7*b* that is placed at a position different from the axial center of the rotary shaft 2*a*, and a guide groove 8*a* is formed in the area of the swaying arm 8 which contacts the stretcher 4.

With the above configuration, the lengths (pivoting radius) of the pivoting arms 8 can be changed in accordance with the position of the shaft 7*b*. In other words, the torque acting on the stretcher 4 can be changed by the frictional force stemming from the belt 3 according to the position of the shaft 7*b* (the torque can be increased in this embodiment). The pressing force used for lightly pressing the belt 3 against the heating roller 1 can be adjusted.

Figure 24:
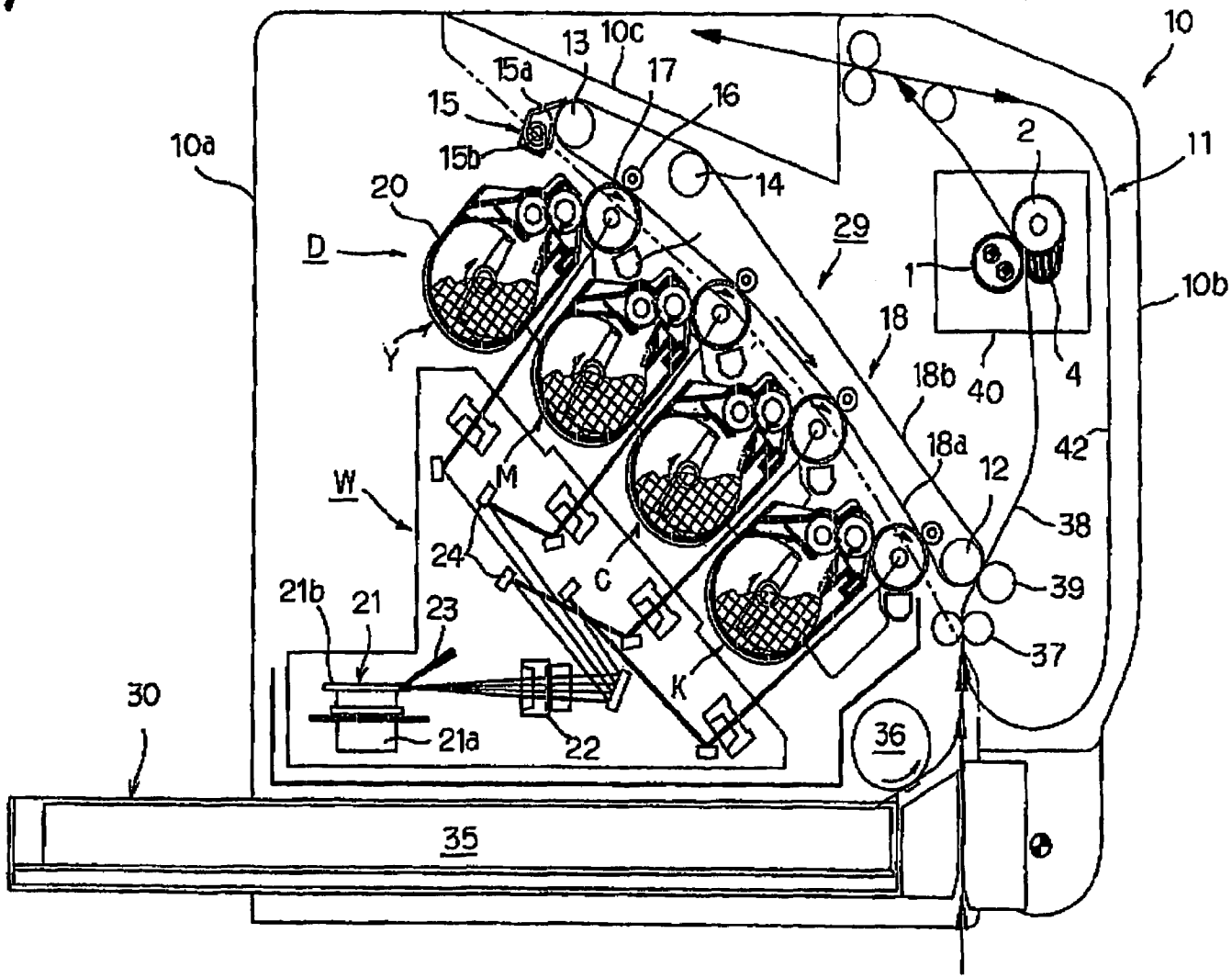
FIG. 24 is a schematic section view of an image forming apparatus incorporating the fusing device of the invention.

FIG. 24 schematically shows an image forming apparatus 10 configured to incorporate the fusing device of the invention. The image forming apparatus 10 comprises: a housing 10*a;* a door body 10*b;* a sheet transporting unit 11; a cleaner 15; an image carrier 17; an image transferer 18; developing devices 20; an optical scanner 21; a rotary polygon mirror 21*b;* a transfer belt unit 29; a sheet feeding unit 30; a fuser 40; an exposer W; and an image forming unit D.

A sheet ejecting tray 10*c* is formed in an upper portion of the housing 10*a* and the door body 10*b* reclosably attached to the front face of the housing 10*a*. The exposer W, the image forming unit D, the transfer belt unit 29, and the sheet feeding unit 30 are provided within the housing 10*a*. The sheet transporting unit 11 is provided within the door body 10*b*. Respective units are configured so as to be removably attached to the main body and temporarily removed for repair or replacement at the time of maintenance or the like.

The image forming unit D comprises Y (yellow), M (magenta), C (cyan), and K (black) image forming stations which form images of a plurality of different colors (four colors in the present embodiment). Each of the Y, M, C, K image forming stations comprises the image carrier 17 formed from a photosensitive drum, a charger 19 formed from a corona discharger, and a developing device 20, both of which are disposed around the image carrier 17. The respective image forming stations Y, M, C, and K are arranged in parallel below the transfer belt unit 29 along an oblique arch-shaped line such that the image carriers 17 are oriented upward. The image forming stations Y, M, C, and K are arranged in an arbitrary sequence.

The transfer belt unit 29 has a drive roller 12 which is disposed at a position below the housing 10*a* and rotationally driven by an unillustrated drive source; a driven roller 13 disposed at an upper oblique position with reference to the drive roller 12; a backup roller (tension roller) 14; the image transferer 18 formed from an intermediate transfer belt which is circulated in the direction of the illustrated arrow (in the countercheck direction X) while being stretched between at least two of these three rollers; and the cleaner 15 that comes into contact with the face of the image transferer 18. The driven roller 13, the backup roller 14, and the image transferer 18 are arranged in the direction inclined leftward in the drawing with reference to the drive roller 12. As a result, a belt face 18*a* whose transporting direction X is oriented downward during driving of the image transferer 18 is located at a lower position, whereas a belt face 18*b* whose transporting direction is oriented upward is situated at a higher location.

Consequently, the image forming stations Y, M, C, and K are arranged in a direction leftwardly inclined with reference to the drive roller 12 in the drawing. The image carriers 17 come into contact with the belt face 18*a* that faces downward with respect to the transporting direction of the image transferer 18 along the arch-shaped line. As indicated by the illustrated arrow, the image carriers 17 are rotated in the transporting direction of the image transferer 18. The image transferer 18 assuming the shape of an elastic endless sleeve is brought into contact with the image carriers 17 at an essentially-identical wrap angle in such a way that the image carriers 17 are covered with the image transferer 18 from above. Accordingly, the contact pressure and the width of nipping portion defined between the image carriers 17 and the image transferer 18 can be adjusted by controlling the tensile force imparted to the image transferer 18 by the tension roller 14, the interval between the image carriers 17, and the wrap angle (the curvature of the arch).

The drive roller 12 serves as a backup roller of a secondary transfer roller 39. For instance, a rubber layer having a thickness of 3 mm or thereabouts and a volume resistivity of $10^5$ Ωcm or less is formed on the periphery of the drive roller 12. The drive roller 12 is grounded by way of a metal shaft, thereby acting as a conductive channel of a secondary transfer bias supplied by way of the secondary transfer roller 39. The diameter of the drive roller 12 is made smaller than that of the driven roller 13 and that of the backup roller 14. As a result, removal of the recording paper which has been subjected to secondary transfer of an image can be facilitated by the elastic force of the recording paper itself. Further, the driven roller 13 doubles as a backup roller for the cleaner 15 to be described later.

A primary transfer member 16 is arranged, at a position where it comes into contact with the inside of the image transferee, as a transfer bias applier which forms an image by sequentially transferring toner images one on top of the other in an overlapping manner. However, the only requirement is to bring the primary transfer member 16 into contact with the inside of the image transferer to ensure application of power to the image transferer. Hence, the primary transfer member 16 can be formed as, e.g., a conductive roller or a rigid contact which is rotationally drive upon contact with the image transferer or a conductive elastic member such as a leaf spring or a conductive brush or the like made of a bundle of resin fibers or the like.

As mentioned previously, the image forming apparatus is configured such that the plurality of image carriers 17 are arranged in parallel; such that the image transferer 18 possessing flexibility is arranged in a contacting manner in a position having an essentially identical wrap angle with respect to the respective image carriers 17; such that the image transferer 18 is stretched by at least two rollers 12, 13 and circulated; and such that tensile force is imparted to the image transferer 18 by any of the rollers 12, 13, thereby sequentially transferring the toner images of the image carriers 17 in a superimposed manner. Essentially-identical nipping portions are readily formed in the contact section between the image carriers 17 and the image transferer 18 in accordance with the essentially-identical wrap angles, thereby rendering the contact pressures substantially identical with each other.

The cleaner 15 is provided on the same side as the belt face 18*a* that faces downward with respect to the transporting direction, and comprises a cleaning blade 15*c* for eliminating the toner still remaining on the face of the image transferer 18 after secondary transfer operation, and a toner transport member 15*g* for transporting recovered toner. The cleaning blade 15*c* remains in contact with the image transferer 18 at the position where the image transferor 18 is passed around the driven roller 13. The primary transfer member 16 remains in contact with the back of the image transferor 18 while opposing the image carriers 17 of the respective image forming stations Y, M, C, and K, which will be described later. A transfer bias is applied to the primary transfer member 16.

The exposer W is provided in a space which is formed at an inclined lower position with reference to the obliquely-arranged image formation unit D. The sheet feeding unit 30 is provided at the bottom of the housing 10*a* and below the exposer W. The entire exposer W is housed in a case, and the case is provided in the space formed at an inclined lower position with reference to the belt face oriented downward in the transporting direction. In an optical system B, a single optical scanner 21 formed from a motor 21*a* and the rotary polygon mirror 21*b* is disposed horizontally on the bottom of the case, and laser beams, which are modulated by image signals of respective colors and originate from a plurality of laser light sources 23, are reflected by the polygon mirror 21*b*, to thus scan over the respective image carriers through deflection. A single f-θ lens 22 and a plurality of reflection mirrors 24 are provided in the optical system B such that scanning optical paths of respective colors are wrapped around not in parallel with the respective image carriers 17.

In the embodiment, the scanning optical system B is disposed in the lower portion of the device. Moreover, the optical scanner 21 is disposed on the bottom of the case. As a result, the vibration imparted to the entire case by the polygon mirror motor 21*a* is minimized. The number of polygon mirror motors 21, which are the vibration sources, is reduced to one, whereby the vibration imparted to the overall case is minimized. The respective image stations Y, M, C, and K are disposed in an oblique direction, and the image carriers 17 are arranged in parallel along the oblique arch-shaped line while being oriented upward. Toner storage containers 26 are arranged in inclined positions while being aligned in an oblique downward direction.

The sheet feeding unit 30 comprises a sheet feeding cassette 35 which stores recording media in a stacked manner, and a pickup roller 36 for feeding the recording medium in a one by one manner from the sheet feeding cassette 35. The sheet feeding unit 11 comprises a pair of gate rollers 37 for determining a timing at which the recording medium is to be fed to a secondary transfer section (one of the rollers is disposed in the housing 10*a*); the secondary transfer roller 39 serving as a secondary transferer which is brought into pressed contact with the drive roller 12 and the image transferer 18; a main sheet transporting path 38; the fuser 40; a pair of sheet ejecting rollers 41; and a sheet transporting path 42 for double-sided printing purpose.

In the embodiment, the fuser 40 can be provided in a space formed at an obliquely above position with reference to the belt face 18*b* oriented upwardly with respect to the transporting direction of the transfer belt. In other words, the fuser 40 can be provided in a space opposite the image forming station with reference to the transfer belt. Transfer of heat to the exposer W, the image transferer 18, and the image forming unit can be diminished, thereby lessening the frequency with which operation for compensating for color misregistration is to be performed. Particularly, the exposer W is located at a position most distant from the fuser 40, and the displacement induced by heat originating from components of the scanning optical system can be minimized, thereby preventing occurrence of color misregistration. Since the image transferer 18 is disposed in a direction inclined with respect to the drive roller 12, a wide space arises in the right side of the drawing, thereby enabling arrangement of the fuser 40. Thus, downsizing of the fusing device can be realized. Further, transfer of the heat originating from the fuser 40 to the exposer W, the image transferor 18, and the respective image forming stations Y, M, C, K, all of which are disposed on the left side of the device, can be prevented. The exposer W can be arranged in the lower left space of the image-forming unit D. Accordingly, vibration of the scanning optical system B of the exposer W, which would otherwise be caused by the vibration imparted to the housing 10*a* by the drive system of the image forming unit, can be minimized, thereby preventing deterioration of image quality.

In the embodiment, the intermediate transfer belt is configured to contact the image carriers 17 as the image transferer 18. A sheet medium transfer belt, which transports a sheet medium while the sheet medium is attached on a face of the belt by suction and which sequentially transfers toner images on the face of the sheet medium in an overlapping manner to thus form an image, may be configured to contact the image carriers 17 as the image transferer 18. In this case, a difference between this alternate configuration and the above-described respective embodiments lies in that the transporting direction of the sheet medium transport belt, which is the image transferer 18, is oriented in an opposite direction; that is, an upward direction, at the lower face which comes into contact with the image carriers 17.

The embodiments of the present invention have been described thus far. However, the present invention is not limited to these embodiments and is susceptible to various modifications. For instance, the above-described embodiments have described a tandem color image forming apparatus and its fusing device, wherein developer units of respective toner colors are arranged side by side. However, needless to say, the present invention can similarly be applied to a rotary-type color image forming apparatus having developer units of respective toner colors mounted on a rotary frame and its fusing device or to a single color or monochrome image forming apparatus and its fusing device.

What is claimed is:

1. A device for fusing a toner image on a recording medium, comprising:

a first roller, provided with a heat source;

a second roller;

a stretcher, elongated in a longitudinal direction of the second roller;

an endless belt, stretched by an outer circumferential face of the second roller and a first face of the stretcher, and circulated in accordance with rotation of the first roller and the second roller, the endless belt being sandwiched between the first roller and the second roller to form a nipping portion through which the recording medium passes to fuse the toner image thereon; and a supporter, disposed between the second roller and the stretcher, the supporter being elongated in the longitudinal direction of the second roller, and provided with at least one first projection having a first face which is brought into slide contact with at least a longitudinal center portion of the outer circumferential face of the second roller.

2. The fusing device as set forth in claim 1, wherein the stretcher is provided with at least one second projection having a second face which is brought into contact with the supporter so as to oppose to the first projection.

3. The fusing device as set forth in claim 1, further comprising:

a pair of arm members, each of which has a first end which is pivotably fitted with a rotary shaft of the second roller and a second end which is coupled with one of longitudinal ends of the stretcher, so that the stretcher is retractably brought into contact with the first roller through the belt; and a coiled spring, interposed between the one of the longitudinal ends of the stretcher and the second end of the arm members so as to urge the stretcher in a direction separating from the second roller.

4. The fusing device as set forth in claim 3, wherein an axial line of the coiled spring passes through a position which is shifted from a rotary axis of the second roller in a direction separating from the first roller.

5. The fusing device as set forth in claim 3, wherein both longitudinal ends of the supporter are pivotably fitted with the rotary shaft of the second roller.

6. The fusing device as set forth in claim 3, wherein both longitudinal ends of the supporter are formed with flanges which are respectively fitted with both longitudinal ends of the second roller.

7. The fusing device as set forth in claim 1, wherein the first face of the first projection and the outer circumferential face of the second roller have an identical curvature.

8. The fusing device as set forth in claim 2, the second face of the second projection and a face of the supporter contacting the second projection have an identical curvature.

9. The fusing device as set forth in claim 1, wherein a portion of the stretcher which is to be brought into contact with the first roller through the belt is made flat.

10. The fusing device as set forth in claim 1, wherein the supporter is provided with a projection, and the stretcher is provided with a hole into which the projection is fitted.

11. The fusing device as set forth in claim 1, further comprising an urging member, which urges the stretcher toward the first roller.

12. The fusing device as set forth in claim 1, wherein a longitudinal center portion of the first face of the stretcher has a smaller curvature than both longitudinal ends thereof.

13. The fusing device as set forth in claim 1, further comprising a plurality of coiled springs, disposed between the stretcher and the supporter and arrayed in the longitudinal direction of the second roller.

14. The fusing device as set forth in claim 1, wherein:

the stretcher is disposed at an upstream side, in the circulating direction of the belt, of a contact position at which the second roller contacts the first roller through the belt; and the belt is wrapped around an outer circumferential face of the first roller by the stretcher to form the nipping portion.

15. The fusing device as set forth in claim 1, wherein:

the stretcher is disposed at a downstream side, in the circulating direction of the belt, of a contact position at which the second roller contacts the first roller through the belt; and the belt is wrapped around an outer circumferential face of the first roller by the stretcher to form the nipping portion.

16. The fusing device as set forth in claim 13, wherein the first projection is provided so as to oppose to each of the coiled springs.

17. The fusing device as set forth in claim 13, wherein an axial line of each of the coiled springs passes through a position which is shifted from a rotary axis of the second roller in a direction separating from the first roller.

18. The fusing device as set forth in claim 13, wherein at least two of the springs have different urging forces.

19. The fusing device as set forth in claim 18, wherein an urging force of one of the springs disposed in a longitudinal center portion of the stretcher is greater than an urging force of another one of the springs disposed in a longitudinal end portion of the stretcher.

20. The fusing device as set forth in claim 18, wherein an urging force of one of the springs disposed in a longitudinal center portion of the stretcher is smaller than an urging force of another one of the springs disposed in a longitudinal end portion of the stretcher.

21. The fusing device as set forth in claim 18, wherein an urging force of two of the springs disposed in a longitudinal center portion and a longitudinal end portion of the stretcher is greater than an urging force of another one of the springs disposed in a position between the longitudinal center portion and the longitudinal end portion.

22. The fusing device as set forth in claim 1, wherein the supporter has a portion operable to press the belt against the first roller.

23. The fusing device as set forth in claim 1, wherein a plurality of the first projections are disposed so as to come in contact with separate positions of the outer circumferential face of the second roller in the longitudinal direction thereof.

24. The fusing device as set forth in claim 1, wherein a plurality of the first projections are disposed so as to come in contact with separate positions of the outer circumferential face of the second roller in a rotating direction thereof.

25. The fusing device as set forth in claim 24, wherein the first projections are provided as roller members.

26. The fusing device as set forth in claim 1, further comprising:

a pair of arm members, each of which has a first end which is pivotably fitted with a shaft member and a second end which is coupled with one of longitudinal ends of the stretcher, so that the stretcher is retractably brought into contact with the first roller through the belt; and a coiled spring, interposed between the one of the longitudinal ends of the stretcher and the second end of the arm members so as to urge the stretcher in a direction separating from the second roller, wherein the shaft member is disposed in the vicinity of a rotary shaft of the second roller.

27. An image forming apparatus incorporating the fusing device as set forth in claim 1, comprising:

an image former, which forms the toner image on the recording medium; and a transporter, which transports the recording medium having the toner image to the fusing device.

* * * * *